US012599818B2

(12) United States Patent
Lambeth et al.

(10) Patent No.: US 12,599,818 B2
(45) Date of Patent: Apr. 14, 2026

(54) GOLF CLUB HEAD

(71) Applicant: SUMITOMO RUBBER INDUSTRIES, LTD., Kobe (JP)

(72) Inventors: Jacob Lambeth, Irvine, CA (US); Dustin Brekke, Fountain Valley, CA (US); Patrick Ripp, Huntington Beach, CA (US)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 461 days.

(21) Appl. No.: 17/519,975

(22) Filed: Nov. 5, 2021

(65) Prior Publication Data

US 2022/0370864 A1 Nov. 24, 2022

Related U.S. Application Data

(60) Provisional application No. 63/201,937, filed on May 19, 2021.

(51) Int. Cl.
*A63B 53/04* (2015.01)

(52) U.S. Cl.
CPC ..... *A63B 53/0408* (2020.08); *A63B 53/047* (2013.01)

(58) Field of Classification Search
CPC ... A63B 53/0408; A63B 53/047; A63B 53/02; A63B 2053/0479
See application file for complete search history.

(56) References Cited

U.S. PATENT DOCUMENTS

| | | | | |
|---|---|---|---|---|
| 4,840,380 | A * | 6/1989 | Kajita | A63B 60/46 473/291 |
| 5,499,819 | A * | 3/1996 | Nagamoto | A63B 60/00 473/346 |
| 6,602,147 | B2 * | 8/2003 | Shiraishi | A63B 53/0466 473/409 |
| 6,830,519 | B2 * | 12/2004 | Reed | A63B 53/047 473/290 |
| 7,137,903 | B2 * | 11/2006 | Best | A63B 53/047 473/290 |
| 9,814,950 | B2 * | 11/2017 | Lytle | A63B 53/047 |
| 10,065,087 | B2 * | 9/2018 | Sander | A63B 53/0466 |
| 10,981,039 | B1 * | 4/2021 | Ripp | A63B 60/04 |
| 11,130,023 | B1 * | 9/2021 | Brekke | A63B 53/0475 |

(Continued)

FOREIGN PATENT DOCUMENTS

| | | | | |
|---|---|---|---|---|
| JP | H06205859 A | * | 12/1993 | |
| JP | 3227351 U | * | 8/2020 | A63B 53/047 |

*Primary Examiner* — William M Pierce
(74) *Attorney, Agent, or Firm* — Oliff PLC

(57) ABSTRACT

A golf club head includes a striking face having a face center and defining a face plane. A vertical center plane is perpendicular to the face plane and passes through the face center. The golf club head further includes a hosel configured to receive a shaft and defining a hosel axis. The golf club head mass is between about 250 g and 320 g, a loft, L, is no less than 39°, a club head center of gravity is spaced rearward from the face plane by a distance, D5, such that D5≤7.69 mm−0.074 mm/°*L, and spaced from the vertical center plane by a distance, D7, that is no greater than 5 mm. A moment of inertia, Iyy, measured about an axis extending in the heel to toe direction and passing through the center of gravity, is no less than 1000 g*cm$^2$.

18 Claims, 19 Drawing Sheets

(56) References Cited

U.S. PATENT DOCUMENTS

| | | | | |
|---|---|---|---|---|
| 2018/0093145 | A1* | 4/2018 | Ripp | A63B 60/50 |
| 2018/0253774 | A1* | 9/2018 | Soracco | B22F 5/10 |
| 2018/0296883 | A1* | 10/2018 | Kii | A63B 53/047 |
| 2019/0168084 | A1* | 6/2019 | Seagram | C23C 24/04 |
| 2019/0217162 | A1* | 7/2019 | Seagram | A63B 53/02 |
| 2019/0381370 | A1* | 12/2019 | Greaney | A63B 53/08 |
| 2020/0086386 | A1* | 3/2020 | Koehler | B22F 10/38 |
| 2021/0052952 | A1* | 2/2021 | Brekke | A63B 53/047 |
| 2021/0178235 | A1* | 6/2021 | Halberg | A63B 60/52 |
| 2021/0387060 | A1* | 12/2021 | Brekke | B22D 19/00 |
| 2022/0001249 | A1* | 1/2022 | Lambeth | A63B 60/52 |
| 2022/0054900 | A1* | 2/2022 | Cleghorn | A63B 60/02 |
| 2022/0111268 | A1* | 4/2022 | Johnson | A63B 53/042 |
| 2022/0118326 | A1* | 4/2022 | Halberg | A63B 60/52 |
| 2022/0184475 | A1* | 6/2022 | Hebreo | A63B 53/045 |
| 2022/0370864 | A1* | 11/2022 | Lambeth | A63B 53/0408 |
| 2023/0017480 | A1* | 1/2023 | Clarke | A63B 53/0475 |

* cited by examiner

GOLF CLUB HEAD

RELATED U.S. APPLICATION DATA

This application claims the benefit of U.S. Provisional Patent Application No. 63/201,937, which was filed on May 19, 2021.

BACKGROUND

This disclosure relates generally to the field of golf clubs. More particularly, it relates to a golf club head with an insert in at least the hosel portion of the club head.

A goal of golf club head design is to align the club head's center of gravity with the location on the striking face most likely to come into contact with the golf ball during a swing. This increases shot accuracy and helps ensure that as much energy as possible from the golfer's swing is transferred to the golf ball at impact, thereby resulting in a favorable golf shot.

SUMMARY

But this goal can often be difficult to achieve within the constraints of a given mass budget. This is especially true in connection with "player" iron-type golf club heads, in which the center of gravity of the club head is naturally biased toward the heel side from face center due to the shaping and weight of the heel and hosel portions. Golfers who use these club heads also often enjoy their more traditional look, and these golfers may thus object to changes designed to beneficially alter the weight profile of the club head but that also cause the club head to diverge from this traditional look. For example, perimeter weighting may be added to an iron or wedge-type golf club head to increase its moments of inertia and thereby add "forgiveness" on off-center hits, but the appearance of such a cavity-back club head can be off-putting for players who prefer the appearance of blade-type irons and wedges. Such features also may deleteriously affect sweet spot location, particularly in the case of wedge-type golf club heads, in which backspin characteristics are relevant. A need thus exists for a design that discretely moves weight from one portion of the club head to another so as to move the center of gravity closer to where the golf ball is likely to be struck, most likely the face center of the club head, while also providing forgiveness on off-center hits.

A golf club head according to one or more aspects of the present disclosure thus includes, when oriented in a reference position, a striking face having a face center and defining a face plane; a vertical center plane that is perpendicular to the face plane and extends through the face center; a sole portion; a top portion; a heel portion; a toe portion opposite the heel portion; a hosel portion extending from the heel portion and comprising a hosel bore with an open end for receiving a shaft and a bottom surface, the hosel bore defining a central hosel axis; and a center of gravity spaced less than 5 mm from the vertical center plane. The golf club head may also include a first component of a first material having a first melting point and a first density and a second component having a second melting point higher than the first melting point and a second density less than the first density, the second component (i) being at least partially encapsulated by the first component, (ii) extending into the hosel portion below the hosel bore, and (iii) having a mass less than about 5 g.

A method of manufacturing a golf club head in accordance with one or more aspects of the present disclosure may in turn include steps of: (a) forming an auxiliary component with an auxiliary material; (b) encapsulating, by an investment casting process, the auxiliary component within a golf club head body comprising a primary material; and (c) removing a portion of the auxiliary component to create a hosel bore with an open end and a bottom surface such that an uppermost extent of the auxiliary component is below the bottom surface. The primary material may have a first melting point and a first density, and the auxiliary material may have a second melting point greater than the first melting point and a second density less than the first density. And the golf club head may further include: a striking face having a face center and defining a face plane; a vertical center plane substantially perpendicular to the face plane and passing through the face center; and a center of gravity located less than 5 mm from the vertical center plane.

And another golf club head according to one or more aspects of the present disclosure may include a golf club head main body and an auxiliary component. The golf club head main body may in turn include a striking face having a face center and defining a face plane; a vertical center plane that is perpendicular to the face plane and extends through the face center; a sole portion; a top portion; a heel portion; a toe portion opposite the heel portion; a hosel extending from the heel portion and comprising a hosel bore with an open end and a bottom surface, the hosel bore defining a central hosel axis; and a first material having a first melting point and a first density. The auxiliary component may in turn include a heel portion comprising a second material having a second melting point higher than the first melting point and a second density less than the first density; an upper extent located below the bottom surface of the hosel bore; and a toe portion connected to the heel portion and comprising a third material having a density greater than the first density. And a center of gravity of this golf club head may be located less than 5 mm from the vertical center plane.

These and other features and advantages of the golf club heads and manufacturing methods thereof according to the various aspects of the present disclosure will become more apparent upon consideration of the following description, drawings, and appended claims. The description and drawings described below are for illustrative purposes only and are not intended to limit the scope of the present invention in any manner.

DETAILED DESCRIPTION OF EMBODIMENTS

Figure 1:
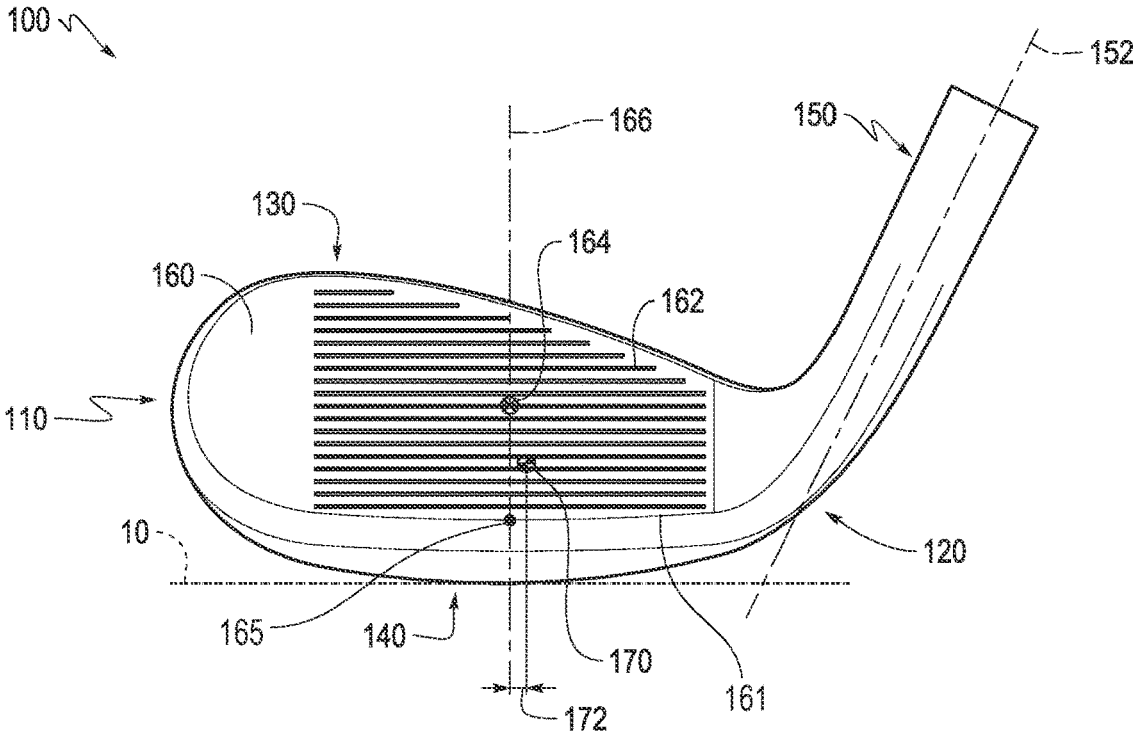
FIG. 1 shows a front elevation view of an exemplary golf club head in accordance with one or more aspects of the present disclosure.
Figure 2:
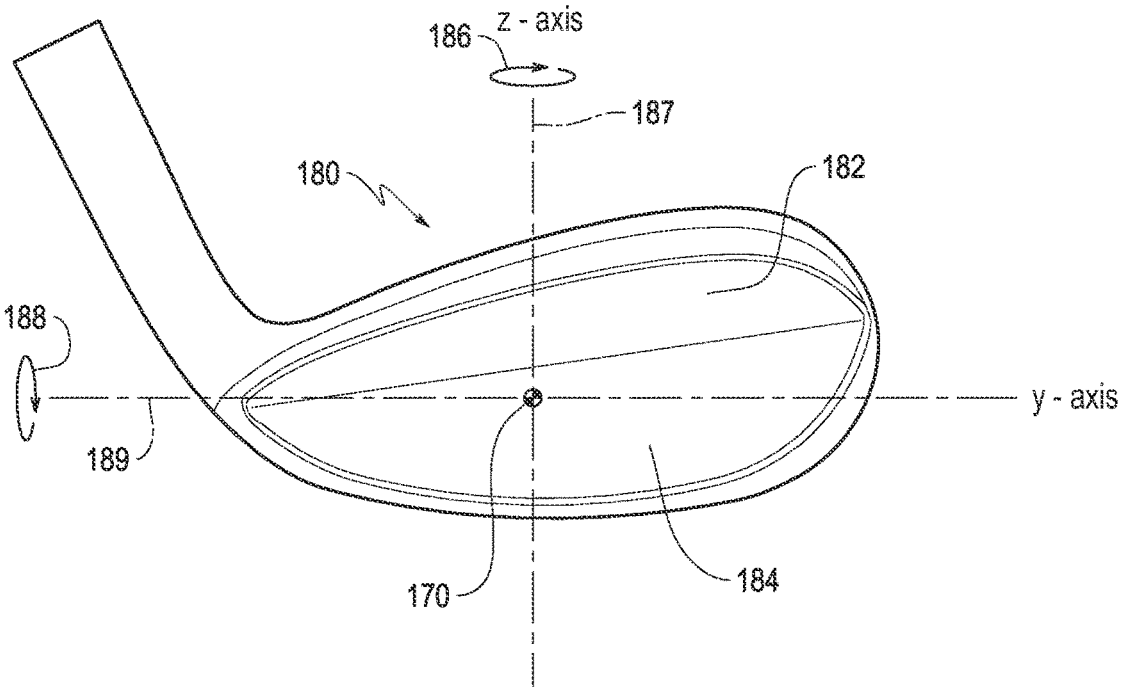
FIG. 2 shows a rear schematic view of the exemplary golf club head of FIG. 1.

Shown in FIGS. 1 and 2 is a golf club head 100 in accordance with one or more aspects of the present disclosure. A main body of this golf club head may be bounded by a toe portion 110, a heel portion 120 opposite the toe portion, a top portion 130, and a sole portion 140 opposite the top portion. A hosel portion 150 for securing the club head to an associated shaft (not shown) may extend from the heel portion, and the hosel portion may in turn define a virtual central hosel axis 152.

The club head may further include a striking face 160 at a front portion thereof. The striking face is the substantially planar exterior surface part of the front portion that generally conforms to a virtual striking face plane 76 and that is arranged to contact a golf ball at a factory-designated loft angle taken between the striking face plane 76 and the central hosel axis 152. The striking face may be formed with surface features that increase traction between the striking face and a struck golf ball to ensure both good contact with the ball (for example, in wet conditions) and impart a degree of spin to the ball, e.g., for stability in flight or to control better the rest position of a struck golf ball once it has returned to the ground by way of backspin. Included in these surface features may be a plurality of substantially parallel horizontal grooves or score lines 162 as well as other surface features (not shown) that form a texture pattern. The striking face may include a leading edge 161 constituting the junction formed between the generally planar striking face 160 and the sole portion 140. The leading edge 161 includes a forwardmost point 165 (see FIGS. 1 and 3). A virtual vertical center plane 166 passes through the forwardmost point 165 of the leading edge 161. The striking face may include a face center 164. Face center, as used herein, refers to the point on the striking face of the club head that is halfway between the topmost extent and sole-most extent of the score lines and that passes through the virtual center plane 166. In some embodiments, for example the embodiment shown in FIG. 1, the face center is preferably also located halfway between a heel-most extent and a toe-most extent of the scorelines. However, in alternative embodiments, the face center is not located halfway between the heel-most extent and the toe-most extent of the scorelines. For example, the scorelines may be laterally offset from the leading edge contour or the scorelines may fully extend into the toe portion of the striking face. A virtual vertical center plane 166 perpendicular to the face plane may project through the face center in the front-to-rear direction of the club head, and a center of gravity 170 of the golf club head may be spaced from that virtual vertical center plane. In FIG. 1, for example, the center of gravity may be spaced heelward from the virtual vertical center plane. The center of gravity may be spaced by a distance 172 less than 5 mm from the virtual vertical center plane, and in more preferred embodiments, it may be spaced less than 2 mm from that virtual vertical center plane.

The golf club head is shown in FIG. 1 as being in the "reference position." As used herein, "reference position" denotes a position of a golf club head, e.g., the club head of FIG. 1, in which the sole portion of the club head contacts a virtual ground plane 10 such that the virtual central hosel axis 152 of the hosel portion lies in a virtual vertical hosel plane and the score lines 162 are oriented horizontally relative to the ground plane 10. Unless otherwise specified, all club head dimensions described herein are taken with the club head in the reference position.

The golf club head of FIGS. 1 and 2 preferably comprises an iron-type club head such as a wedge-type club head, and it may preferably have a loft angle of no less than 40°. More preferably, the golf club head may be a traditional blade-type club head, which may otherwise be referred to as a "player"-type club head by certain golfers. As such, and as shown in FIG. 2, a rear 180 of the club head may include an upper blade portion 182 and a lower muscle portion 184. The upper blade portion may preferably comprise a substantially planar surface, and it may thus preferably lack any substantial perimeter-weighting features. The muscle portion may project rearward from the upper blade portion in a direction perpendicular to the plane of the striking face. Mass of the golf club head may be generally concentrated in the muscle portion, so the center of gravity 170 may be located soleward of the face center. And as shown in FIG. 2 specifically, moment of inertia ("MOI") Izz 186 of the golf club head may be measured about a virtual vertical axis 187 passing through the center of gravity, and MOI Ixx 188 of the golf club head may be measured about a virtual horizontal axis 189, parallel to the ground plane 10, that likewise passes through the center of gravity. As known to those of ordinary skill in the art, MOI is generally correlated with increasing the club head's natural resistance to rotation about a certain axis on off-centered golf ball impacts.

The golf club head of one or more aspects of this disclosure preferably has an internal structure that, compared to other "player"-type golf club heads, discretely moves weight from the heel portion or lower hosel portion to the sole/muscle portion or to the top of the hosel portion, thereby moving the center of gravity closer to the face center, i.e., where experienced golfers are more likely to hit the golf ball on the striking face, and correspondingly increasing both vertical (Izz) and horizontal (Ixx) MOI. Exemplary golf club heads having such an internal structure are described below. Each of these exemplary club heads may include the main body structure described above in connection with FIGS. 1 and 2.

Figure 3:
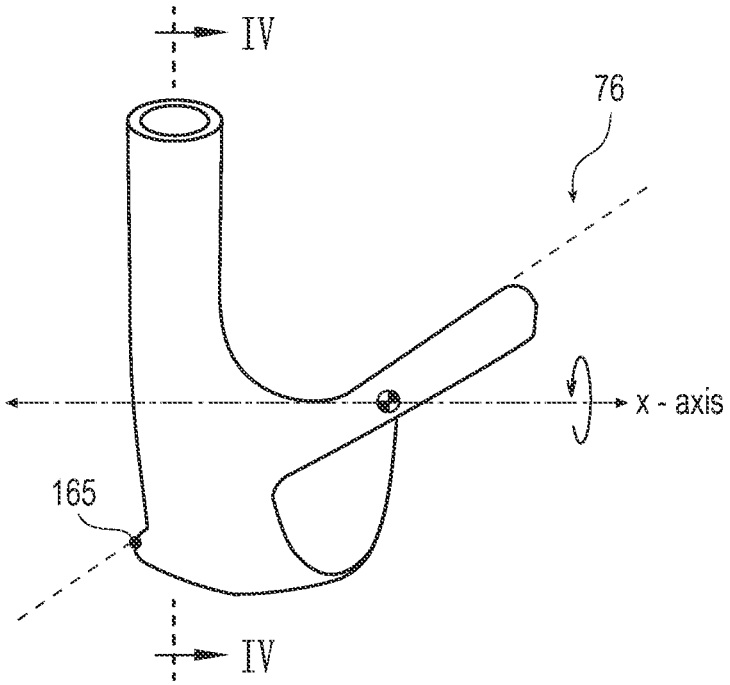
FIG. 3 shows a heel-side elevation view of an exemplary golf club head in accordance with one or more aspects of the present disclosure.
Figure 4:
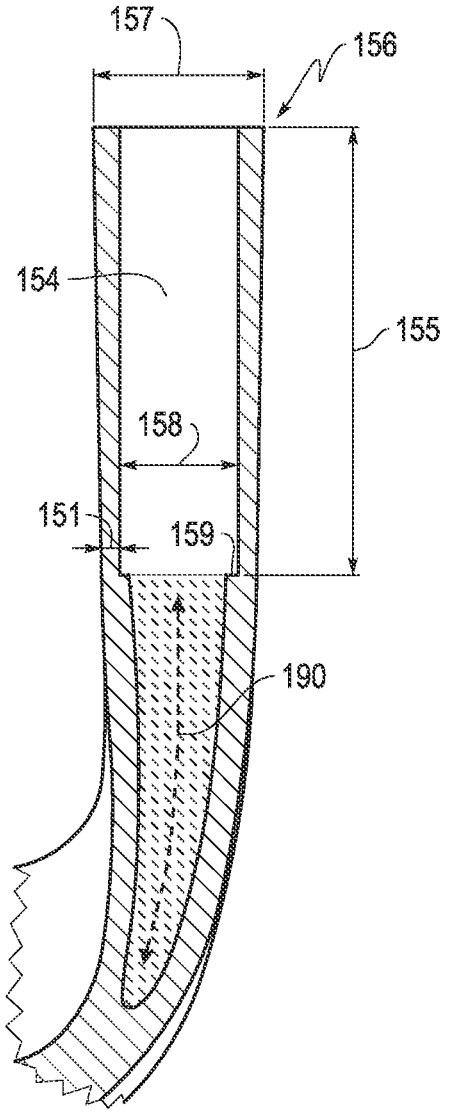
FIG. 4 shows a cross-section of the golf club head of FIG. 3 along the line IV-IV.

FIG. 4 shows a cross-section of a golf club head according to one aspect of the present disclosure taken along line IV-IV in FIG. 3. As shown, the hosel portion 150 of this club head may include a hosel bore 154 extending a depth 155 into the hosel portion from an open, topmost end 156 of the hosel portion. This bore may possess a top inner diameter 157 and a bottom inner diameter 158, which may be the same or may be different. And the hosel bore may terminate at its bottom at a metal shelf 159 that projects inward toward the virtual central hosel axis 152. The hosel portion sidewall (as well as the remainder of the golf club head main body) may constitute a first component preferably formed of a primary material such as steel and/or a material having a density no less than 8 g/cm$^3$ and/or a melting point below 1600° C. And a minimum thickness 151 of the hosel portion sidewall, preferably measured at a bottom of the hosel bore, may be sufficient to ensure structural integrity of the hosel portion without negatively affecting vibrational feedback on golf shots. For example, this minimum thickness may be no less than 0.5 mm, and more preferably no less than 0.75 mm.

Soleward of the bottom of the hosel bore may be an insert 190 that serves as a second, or auxiliary, component. The insert may include a substantially cylindrical portion 192 (FIG. 8) with a central axis that is coaxial with the virtual central hosel axis 152. The insert may also include a heel portion shaped to generally conform to a heel contour of the golf club head. This insert may be formed of an auxiliary material such as a ceramic, and it may preferably have a melting point higher than that of the first component and a density less than that of the first component. As such, the insert may have a mass less than about 5 g in the golf club head, and relative to the overall mass of the golf club head, the mass of the insert may be less than 1.5%. This insert may by composed of at least 60% aluminum oxide ($Al_2O_3$). More specifically, this ceramic insert may be composed of 20% $SiO_2$, 10% $ZrO_2$, and 70% $Al_2O_3$, although each of these percentages may vary by up to about 10%. By adjusting the ceramic composition, material properties of the insert may be tuned to achieve a weight distribution target, e.g., increased moment of inertia, lower and/or centered center of gravity location, or a particular vibrational frequency upon impact. The insert may also possess the following properties: (i) a bonding strength of 15 MPa; (ii) a porosity of no more than 40%, preferably 30%; (iii) absorption of 30%; (iv) a melting point greater than 2500° C.; and (v) a density no greater than 3 g/cm$^3$, preferably no greater than 2 g/cm$^3$. But like the composition of the insert, the insert's bonding strength, porosity, absorption, and density may vary to achieve a particular weight distribution target.

Figure 5:
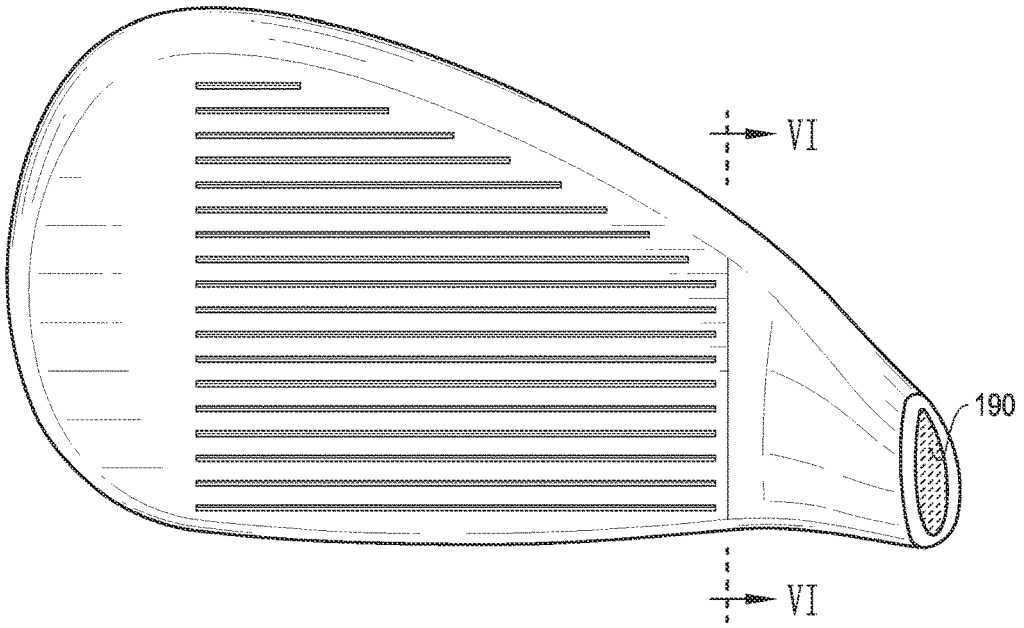
FIG. 5 shows a front perspective view of the golf club head of FIG. 3 with the hosel removed.
Figure 6:
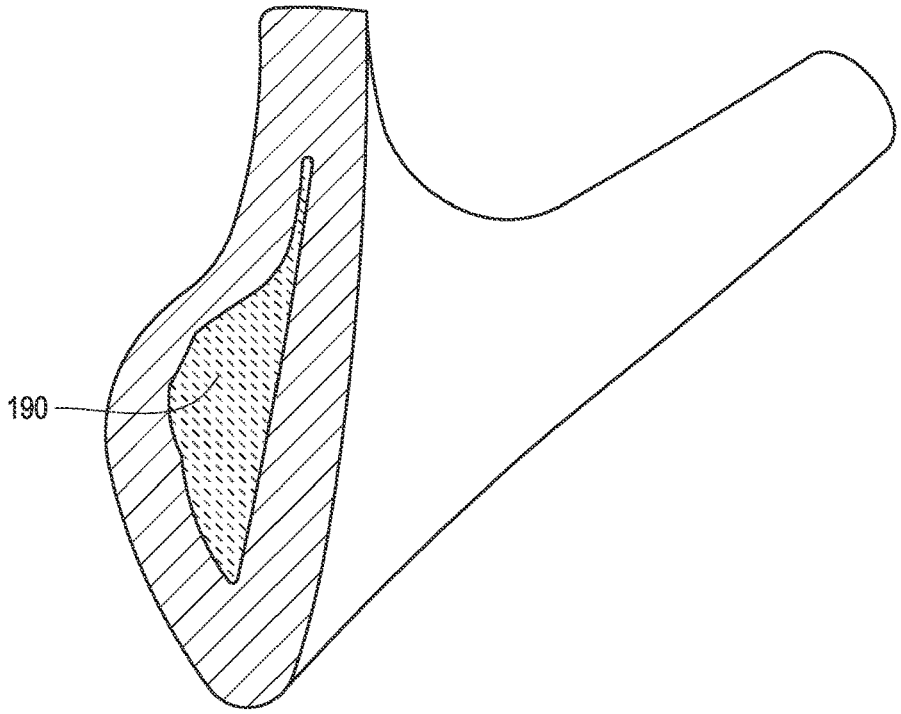
FIG. 6 shows a cross-section of the golf club head of FIG. 5 along the line VI-VI.

As shown in FIG. 6, which shows a cross-section taken at the line VI-VI in FIG. 5, the insert 190 may extend from the hosel portion into the heel portion of the golf club head. And this insert may impact various MOI values of the golf club head. For example, vertical MOI Izz may be greater than 3,000 g*cm$^2$, and horizontal MOI Ixx may be greater than 1,000 g*cm$^2$.

Figure 7:
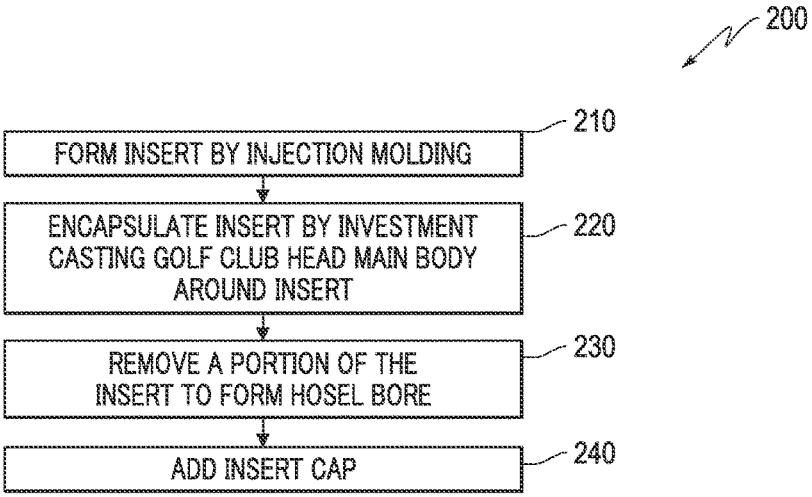
FIG. 7 shows an exemplary method of manufacturing the golf club head of FIG. 3.
Figure 8:
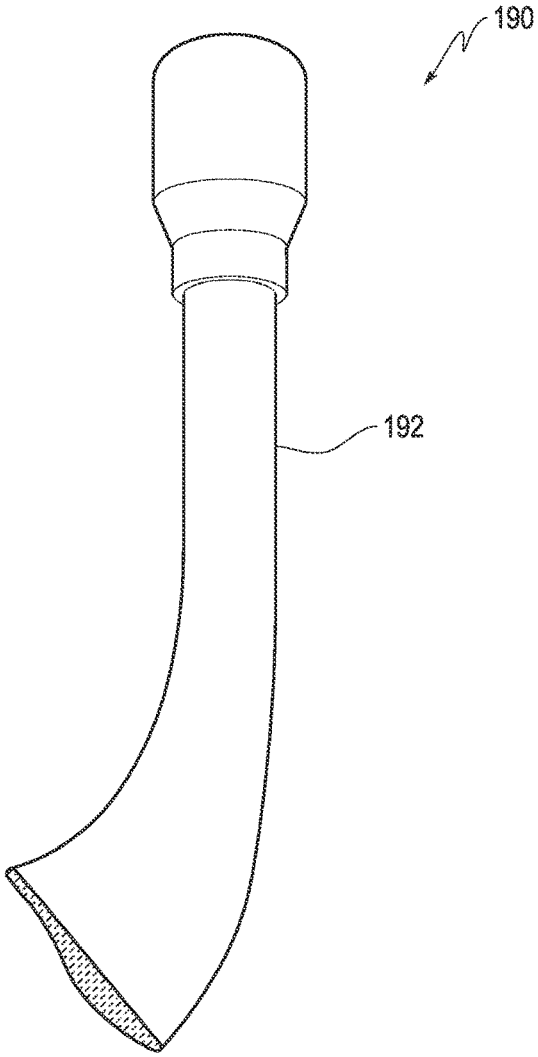
FIG. 8 shows a close-up view of the insert within the golf club head of FIG. 3.
Figure 9:
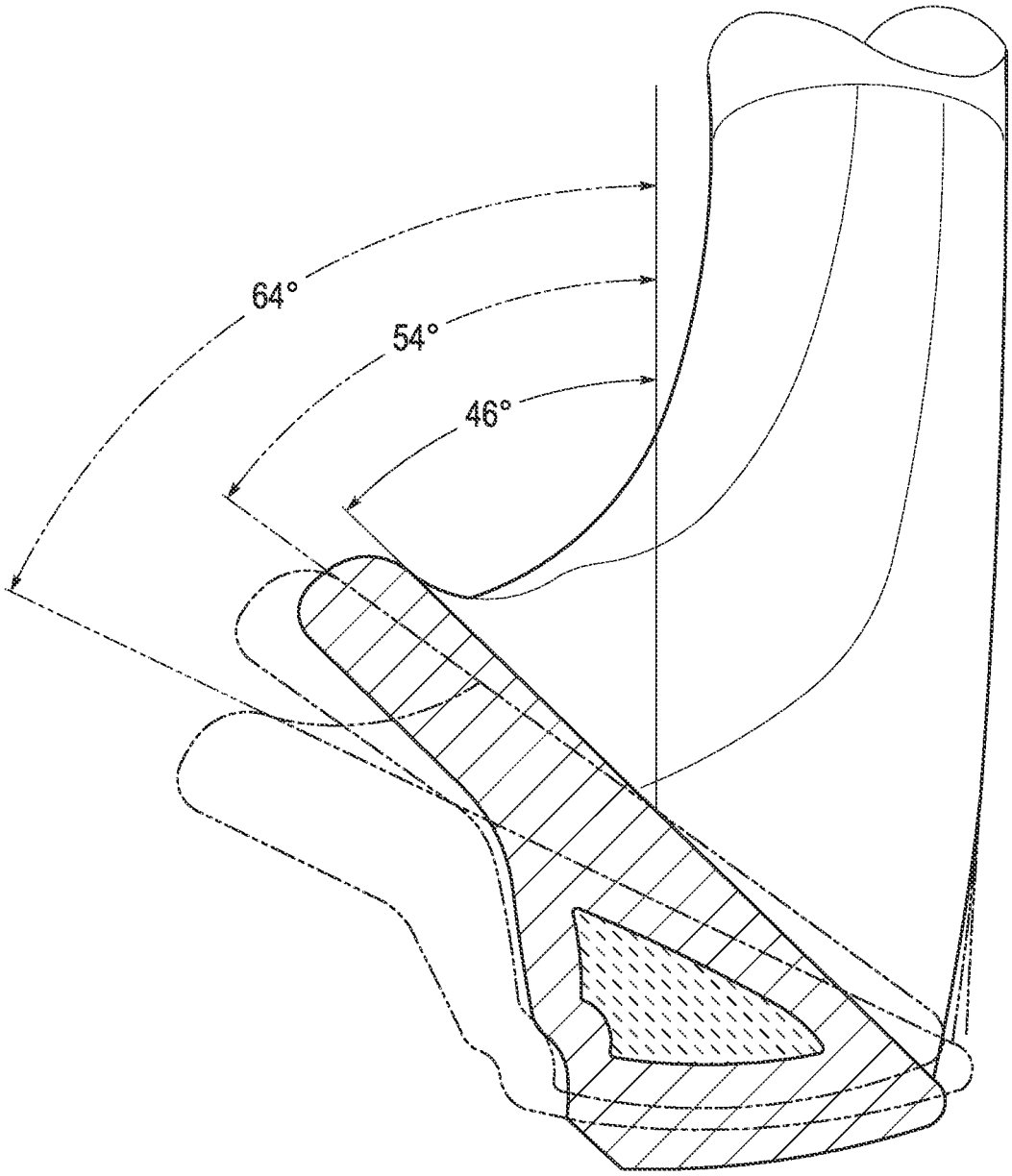
FIG. 9 shows overlapping club heads as part of a method of designing the insert of FIG. 8.

FIGS. 7-12 show an exemplary method 200 of forming the golf club head of FIGS. 3-6. In a first step 210, the insert may be formed by, e.g., injection molding. FIG. 8 shows one embodiment of the insert 190 after this first forming step. This insert may preferably be designed by overlaying various club lofts in a computer-assisted design ("CAD") program and selecting an overlapping region of those club heads while accounting for necessary constraints such as minimal steel wall thickness for integrity of the hosel and/or heel portions. For example, FIG. 9 shows an insert formed in an overlapping area of club heads having lofts of 46°, 54°, and 64°. This design process may ease manufacturing concerns and provide various cost benefits since a new insert is not required to be designed for each golf club head loft and sole shape. In one or more embodiments, a minimum steel wall thickness is no less than 0.5 mm and more preferably no less than 0.75 mm.

Figure 10:
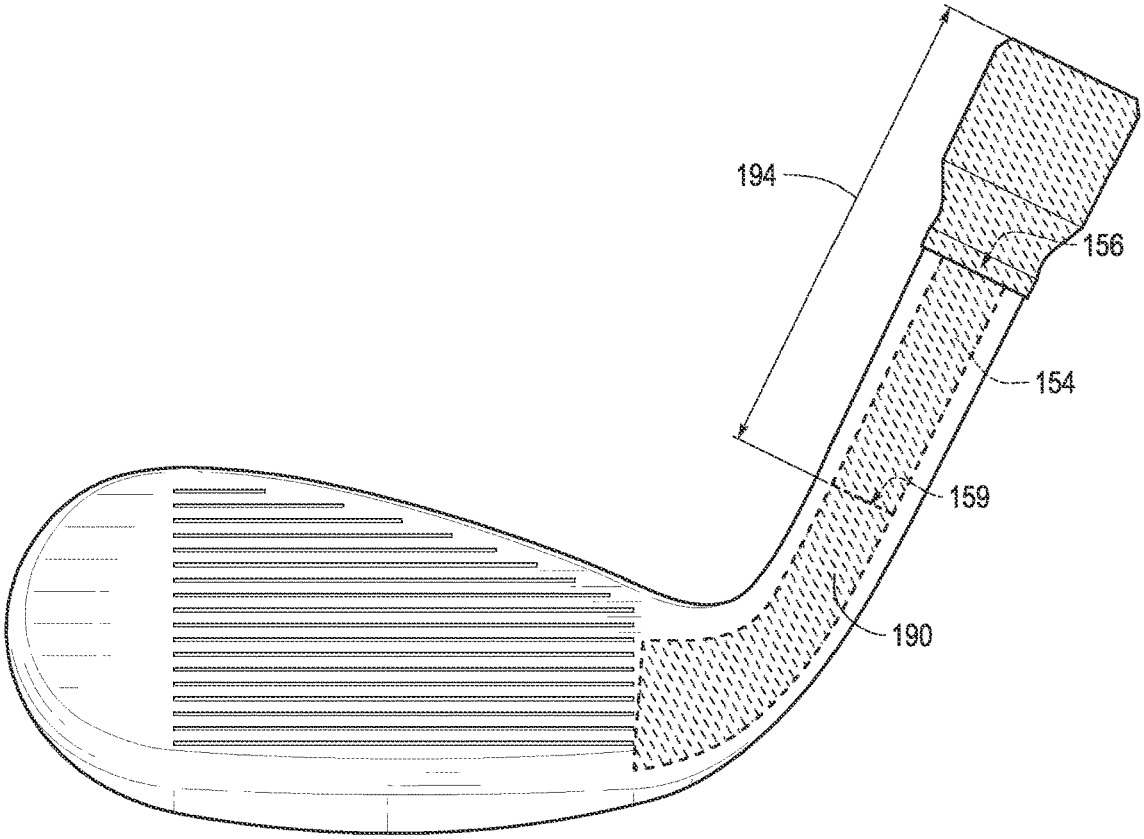
FIG. 10 shows a golf club head resulting from a second step of the method of FIG. 7.
Figure 11:
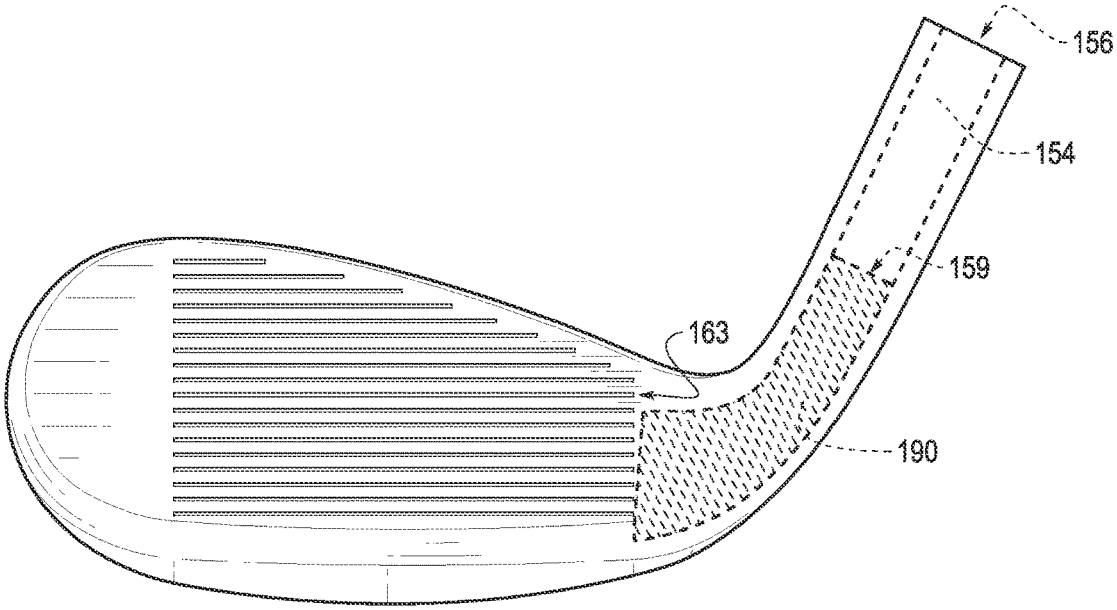
FIG. 11 shows a golf club head resulting from a third step of the method of FIG. 7.
Figure 12:
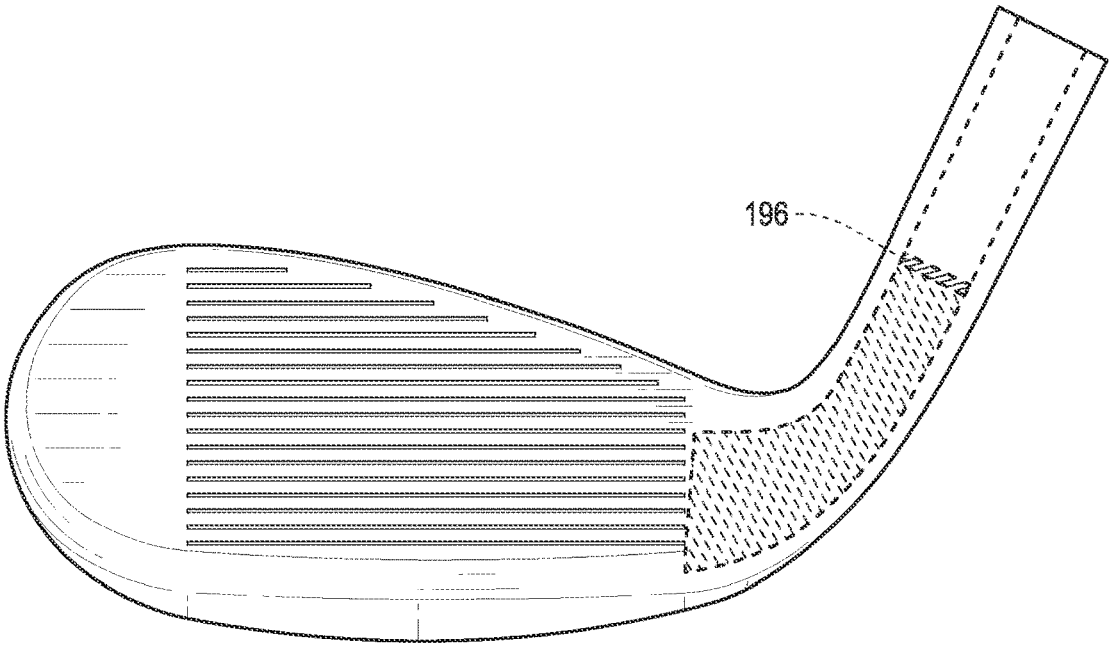
FIG. 12 shows a golf club head resulting from a fourth step of the method of FIG. 7.

In the second step 220 shown in FIG. 7, the golf club head main body may then be formed, e.g., by investment casting, around the insert 190 so to encapsulate the insert therein. The result of this step is shown in FIG. 10, in which the insert is shown to extend not only below the bottom metal shelf 159 of the hosel bore but also through the hosel bore and beyond the opening at the topmost end 156 of the hosel portion 150. The upper part 194 of the insert, i.e., the portions extending beyond the topmost opening of the hosel portion and extending into the hosel bore, may then be removed in the third step 230 shown in FIG. 7 by, e.g., machining. As shown in FIG. 11, which shows the result of this third step, the hosel bore 154 and topmost end 156 of the hosel portion may now be open so as to be able to receive a golf club shaft, and the insert 190 may extend soleward of the metal shelf 159 delimiting the bottom of the hosel bore. As also shown in FIG. 11, the insert may not extend beyond the heel-most extent 163 of the score lines formed on the striking face. Preferably, the insert may extend to about the heel-most extent of those score lines. This ensures that the insert does not extend into the hitting zone of the striking face, which may minimize any change to traditional feel and sound of the golf club head at impact with the golf ball. And in the final step 240 of FIG. 7, the result of which is shown in FIG. 12, an insert cap 196 may be introduced into the hosel bore so as to rest on the metal shelf 159. This insert cap, which may be formed of Al or ABS plastic, may provide a protective barrier between a tip end of the shaft and the topmost end of the insert. In other embodiments, the insert cap may not be necessary, as the topmost end of the insert is covered by an epoxy layer when the tip end of the shaft is affixed in the hosel bore. By thus forming the main body of the golf club head around the insert, space that would otherwise be filled by denser metallic material is instead occupied by, e.g., a ceramic material. Mass is thus selectively removed from the hosel and heel portions, thereby accomplishing the goal of moving the center of gravity closer to the face center.

Figure 13:
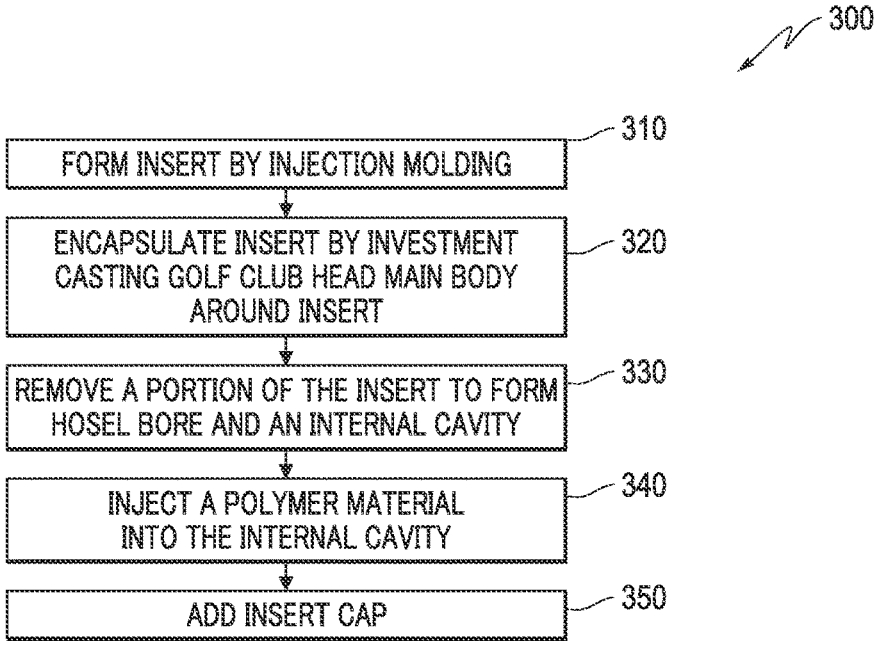
FIG. 13 shows an exemplary method of manufacturing a golf club head in accordance with one or more aspects of the present disclosure.
Figure 14:
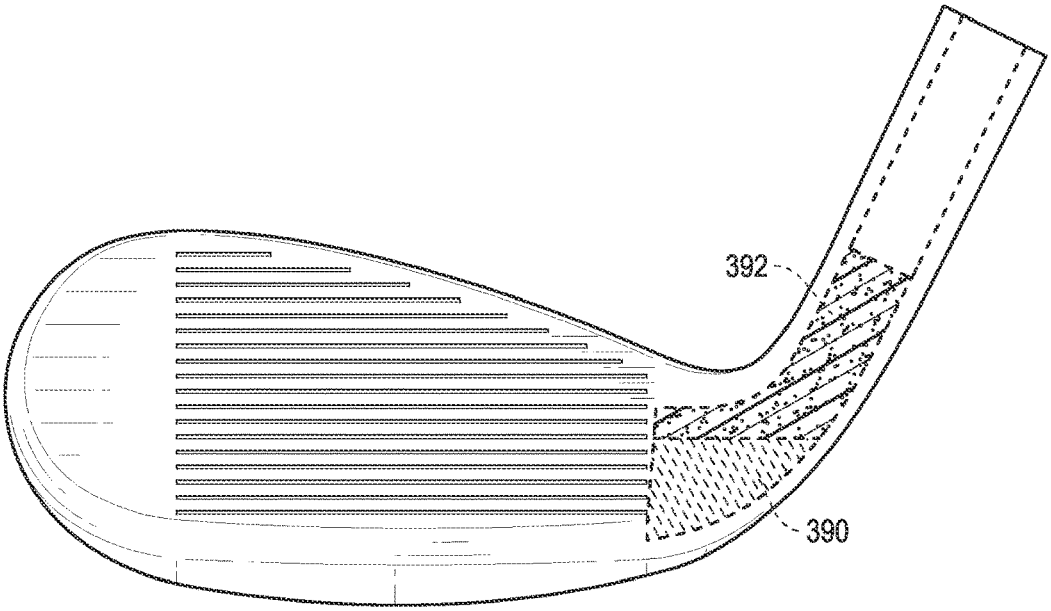
FIG. 14 shows a golf club head resulting from a fourth step of the method of FIG. 13.
Figure 15:
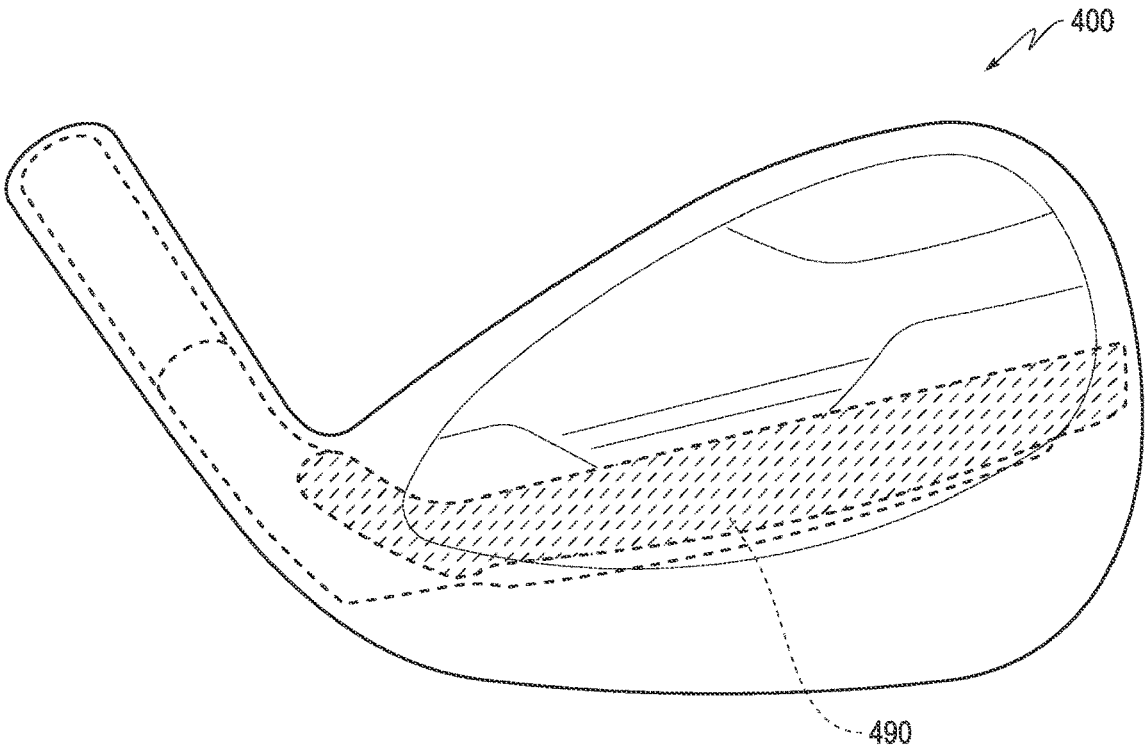
FIG. 15 shows a rear cutaway view of a golf club head in accordance with one or more aspects of the present disclosure.
Figure 16:
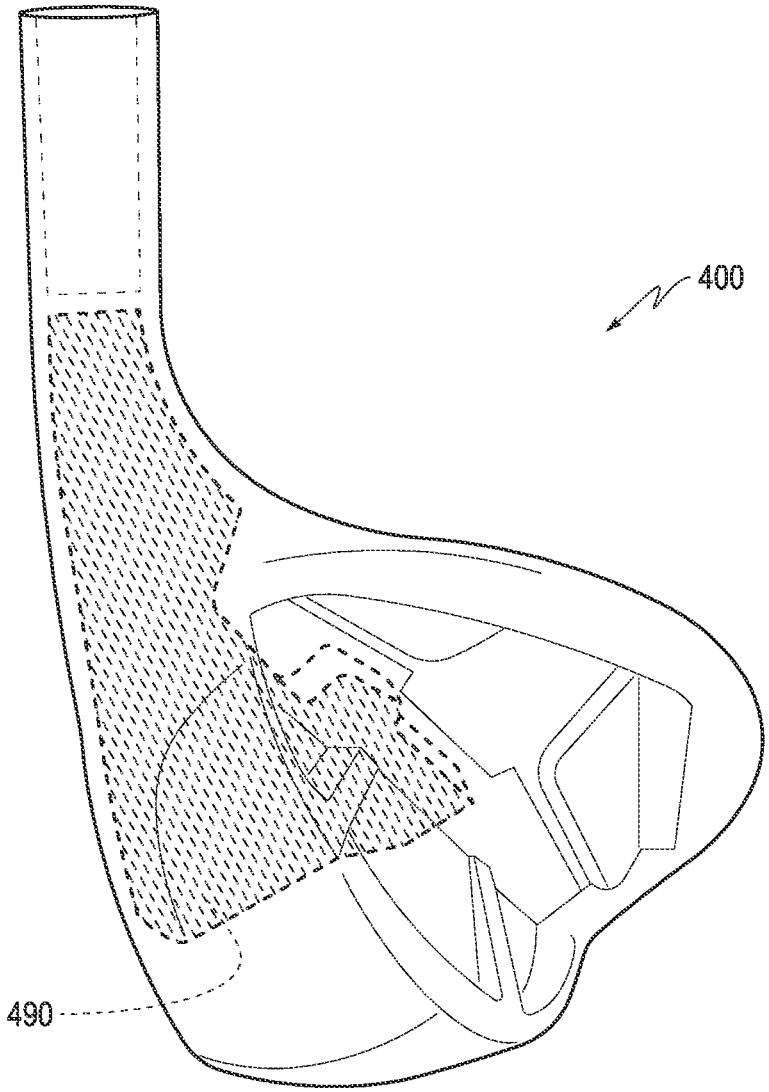
FIG. 16 shows a heel-side cutaway view of the golf club head of FIG. 15.

Other exemplary club heads are seen as being within the spirit and scope of the present invention. For example, as shown in FIG. 13 and like the method of FIG. 7, an insert 390 may first by formed at a first step 310 by, e.g., injection molding, and the main body of the golf club head may then be formed around the insert at a second step 320 by, e.g., investment casting. But at a third step 330, instead of removing only the upper part of the insert so as to form the hosel bore of the hosel portion, more of the insert may be removed so as to form an internal cavity below the hosel bore. More specifically, and as shown in FIG. 14, part 392, e.g., at least 50% by volume, or all of the insert may be removed by, e.g., mechanical agitation, chemical etching, or electrolytic etching, to form the internal cavity. In some aspects, the insert may be comprised of a material having high solubility in water or aqueous solutions. In such aspects, the insert may be easily dissolved out of the golf club head to form the cavity. This cavity may then be filled at the fourth step 340 in FIG. 13 by injecting therein material such as a polymer foam that later solidifies. This fourth step may thus introduce a vibration dampening material within the club head or allow tuning of the location of the center of gravity by, e.g., varying the density of the polymer material. And as in the method of FIG. 7, an insert cap may then be introduced at a fifth step 350 into the hosel bore so as to rest on the metal shelf delimiting the bottom of the hosel bore.

Figure 17:
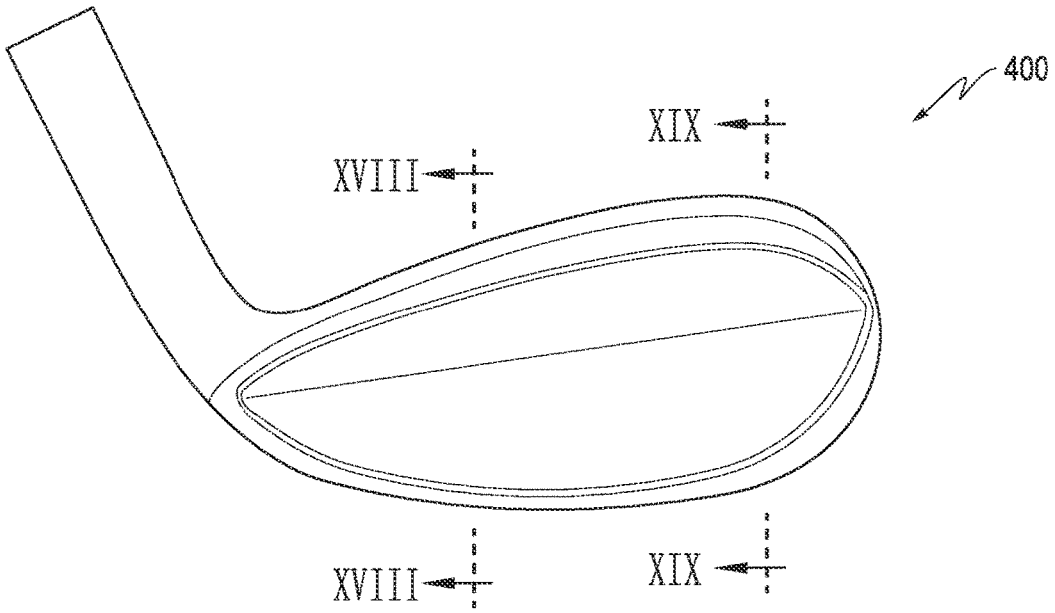
FIG. 17 shows a rear schematic view of the golf club head of FIG. 15.
Figure 18:
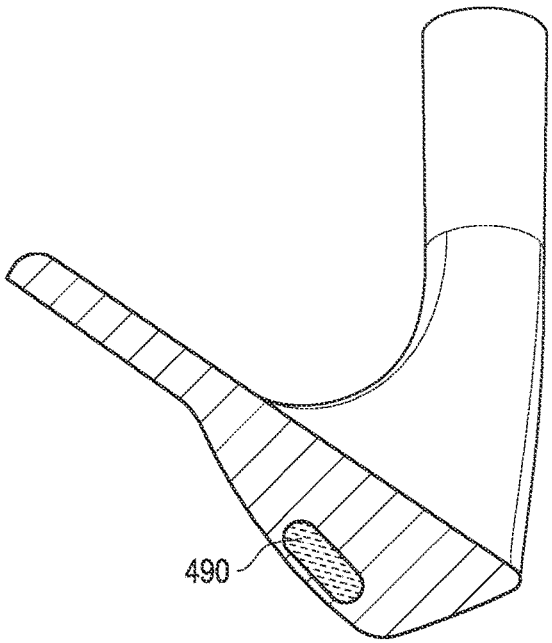
FIG. 18 shows a cross-section of the golf club head of FIG. 17 along the line XVIII-XVIII.
Figure 19:
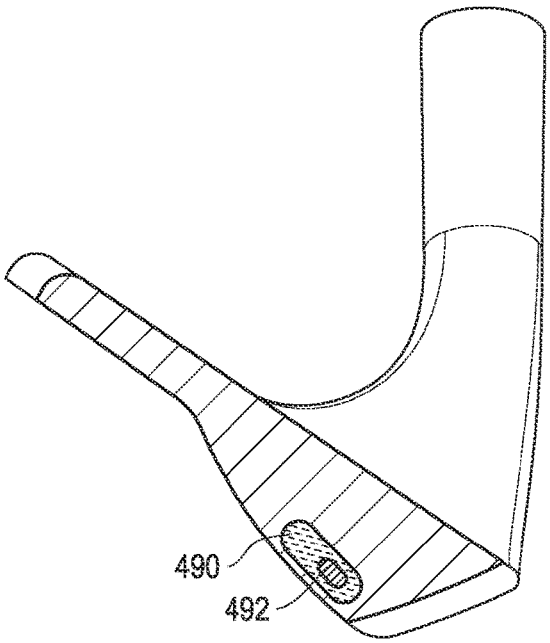
FIG. 19 shows a cross-section of the golf club head of FIG. 17 along the line XIX-XIX.

Yet other exemplary club heads are considered as being within the spirit and scope of the present invention. For example, although FIGS. 10-12 and 14 show the insert as extending only to the heel-most extent of the score lines, this need not be the case. Indeed, as shown in the exemplary golf club head 400 of FIGS. 15-19, the insert 490 may extend farther into the sole portion or to the toe portion of the golf club head. This insert may in fact extend the entire distance from the heel to the toe. Such a configuration may be more feasible in "game-improvement" type golf club heads, which generally have a larger sole volume to accommodate such an insert. The golfer using a "game-improvement" club head may also find less objectionable any changes in sound and/or feel that result from the insert extending into the striking face. In fact, the presence of the insert may provide a vibrational dampening effect and improve feel on off-center impacts. And as shown in FIG. 19, which shows a cross-section taken along the line XIX-XIX of the golf club head of FIG. 17, a high density portion 492 may be co-molded with or otherwise located within the insert at the toe portion. This high density portion may be a metallic material, e.g., a tungsten alloy, and it may have a density greater than 10 g/cm$^3$. Including such a high density portion in the insert may be beneficial because it can add mass to the toe portion of the golf club head to increase MOI, it can improve feel of the golf club head upon striking a golf ball, and it may ultimately reduce manufacturing costs.

Figure 20:
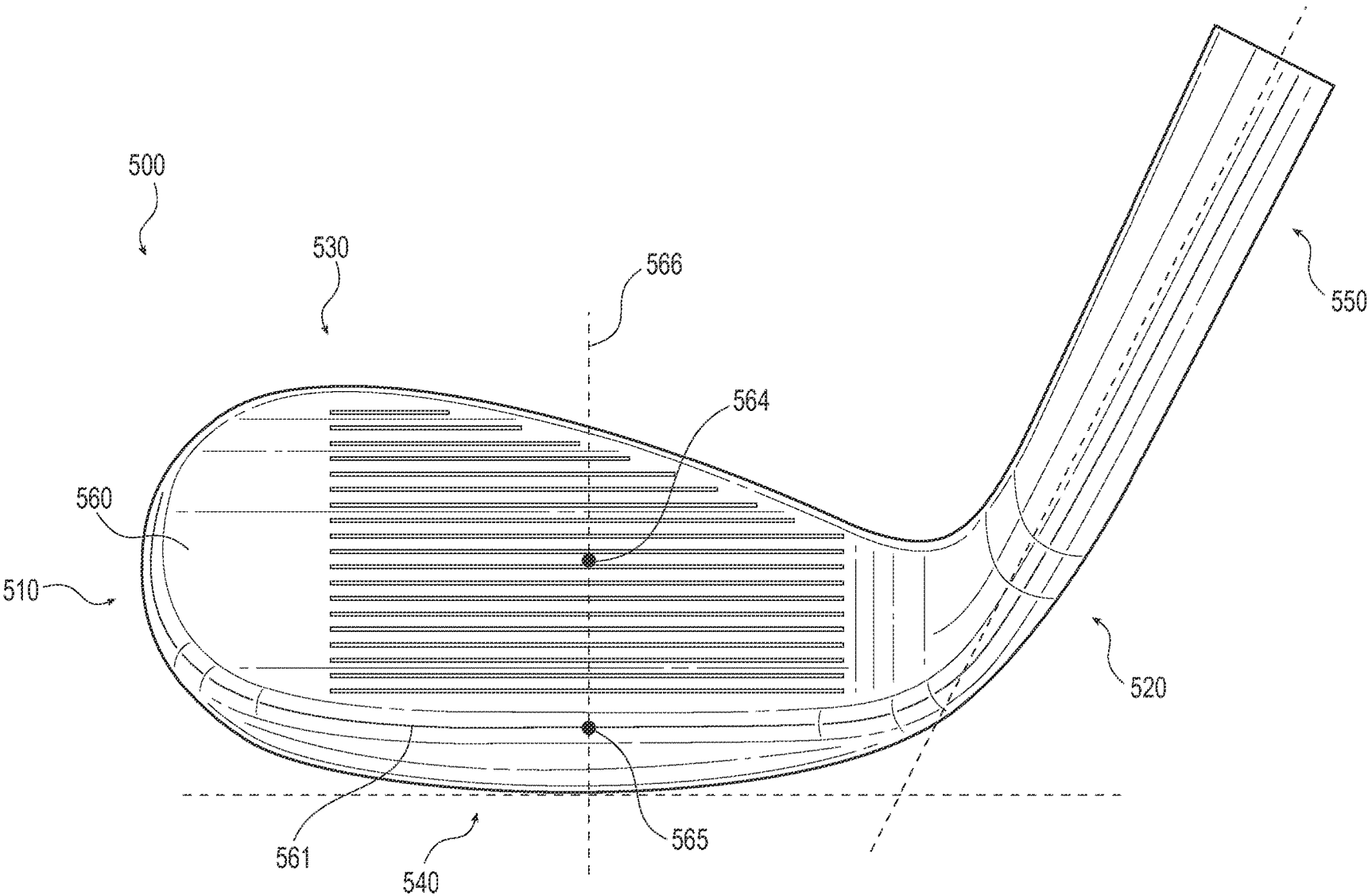
FIG. 20 shows a front elevation view of a golf club head in accordance with a second embodiment of the present disclosure.
Figure 21:
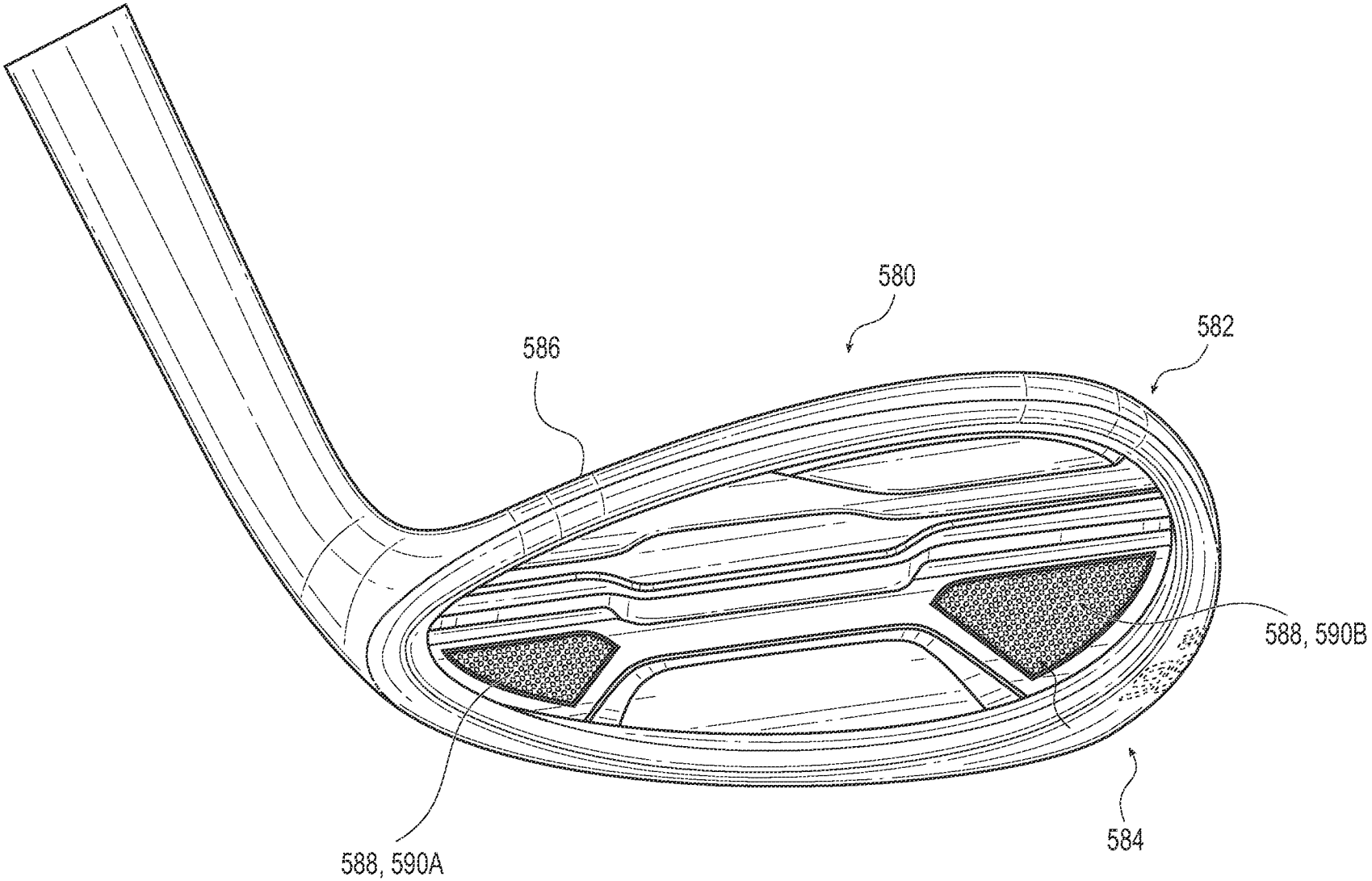
FIG. 21 shows a rear elevation view of the golf club head of FIG. 20.

In FIGS. 20-28, additional golf club head embodiments are shown. Unless particular specified otherwise, the golf club head 500 shown in FIG. 20 is similarly structured, similarly formed, and bears multi-component structure as in the embodiments of FIGS. 1-19. For example, the golf club head 500 includes a sole portion 540, a top portion 530, a heel portion 520, a toe portion 510, a striking face 560 and a rear portion 580 (see e.g. FIG. 21). The striking face 560 includes a leading edge 561 having a forwardmost point 565. A virtual vertical center plane 566 passes through the forwardmost point 565 and a face center 564 as it is defined above with regard to the embodiment of FIG. 1.

The golf club head 500 may be characterized as a game improvement type golf club and more particularly, a game improvement wedge-type golf club head. Accordingly, the golf club head 500 may bear certain features which both depart from and accentuate the features of the golf club head 100 embodiment as shown in FIG. 1. For example, the rear portion 580 of the golf club head 500 includes a blade portion 582 and a muscle portion 584. However, a perimeter-weighting element 586 is formed about the periphery of the rear portion 580. The muscle portion 584 of the rear portion 580 further includes an insert 588. The insert 588 may comprise a resilient material, e.g. a polymeric material such as ABS, TPU, polyurethane, polyamide, polybutadiene, and/or a viscoelastic material for dampening vibrations that may emanate upon impact of the golf club head 500 with a golf ball during use.

The insert 588, in addition to any particular functional aspect, e.g. vibration dampening, acoustical tuning, or feel tuning, may also function to communicate to the golfer a solid, blade-type characteristic and/or aesthetic as is traditionally desired in wedge-type golf club heads. In effect, the insert 588 fills, and thereby conceals, recesses, preferably a heel-side recess 590A and a toe-side recess 590B, with which it mates. This may further enhance the characteristics of the golf club head 500 related to forgiveness on off-centered shots and, in addition, may increase discretionary mass. Such discretionary mass may be relocated to other areas of the golf club head 500 to improve mass-related properties of the golf club head 500 provided a predetermined mass budget.

In addition to a goal of configuring the golf club head 500 for a game improvement class of golfers, the process with which various elements are structured is the result of a design methodology which may depart from that of the embodiment of FIG. 1. In the case of the golf club head 500 of FIG. 20, the various features and elements are particularly sized and contoured on the basis of maximizing expected performance. Specifically, a model is generated representative of impact probability for each of a plurality of locations about the striking face 560 of the club head 500. Next, particular performance characteristics, e.g. ball speed upon impact and/or average carry distance, are measured at each of the plurality of locations about the striking face 560. By associating the probability model with such performance characteristics, a model could be generated that aggregates such information and, on that basis, calculates an overall performance value representative of what a golfer may expect to achieve over a large sampling of golf shots throughout play.

As a result of the generation and execution of such model, various attributes were deemed relatively acceptable, or subject to minimal returns in the case of further manipulation. Yet other attributes were viewed as ripe for further manipulation. In other words, where varying certain attributes may deleteriously affect other attributes, adopting a model using probability-based overall performance may help point to a most desirable combination of attributes.

In particular, and by way of example, increasing Iyy was viewed as worthy of modification. In the specific case of wedge-type golf club heads, golfers tend to impact golf balls on the striking face 560 with high variation in the vertical direction (as compared with say lower-lofted iron-type golf clubs). Yet, as described above with regard to the club head 100 embodiment of FIG. 1, the lateral position of the center of gravity remains an important characteristics of a wedge-type golf club head. Other golf club head aspects are also particular significant, for example the height of the sweet spot on the striking face 560.

For these reasons, and in comparison to the embodiment of FIG. 1, a desire has been identified to largely maintain various desirable characteristics such as sweet spot height and the relatively centered lateral placement of the center of gravity—or at least limit manipulation of those—in favor of manipulating other characteristics, such as to significantly increase Iyy.

This more desirable combination of properties may be achieved in various ways. For example, the golf club head 500 maintains a low density insert similar in form, location and composition to the low density insert 190 as described with regard to the embodiment of FIG. 1. However, in the particular case of golf club head 500, the low density insert 190 is of a higher mass, a higher volume and thus a greater percent volume and percent mass of the overall golf club head.

First, the present inventors determined that a greater insert mass is viable without diminishing the structural integrity of the golf club head 500 below an acceptable threshold. Second, greater insert volume may be achieved if plural, different low density inserts are implemented across a set or portfolio or offering of plural loft-varying golf club heads. With regard to the embodiment of FIG. 1, identically-shaped low-density inserts had been suggested to be associated with each of a plurality of golf club heads constituting a set or portfolio, each golf club head varying in loft. As result, a design envelope within which the low density insert may fit was considered to be the net overlapped space of all such golf club heads superimposed on each other in like orientation. If, instead, plural different low density inserts are permitted to be incorporated into a set of differently-lofted club heads, then fewer overlapped club heads need be superimposed per low density insert or no overlapping at all. As a result, in general, the design envelopes may be larger, permitting greater overall design freedom across the set or offering.

Figure 25:
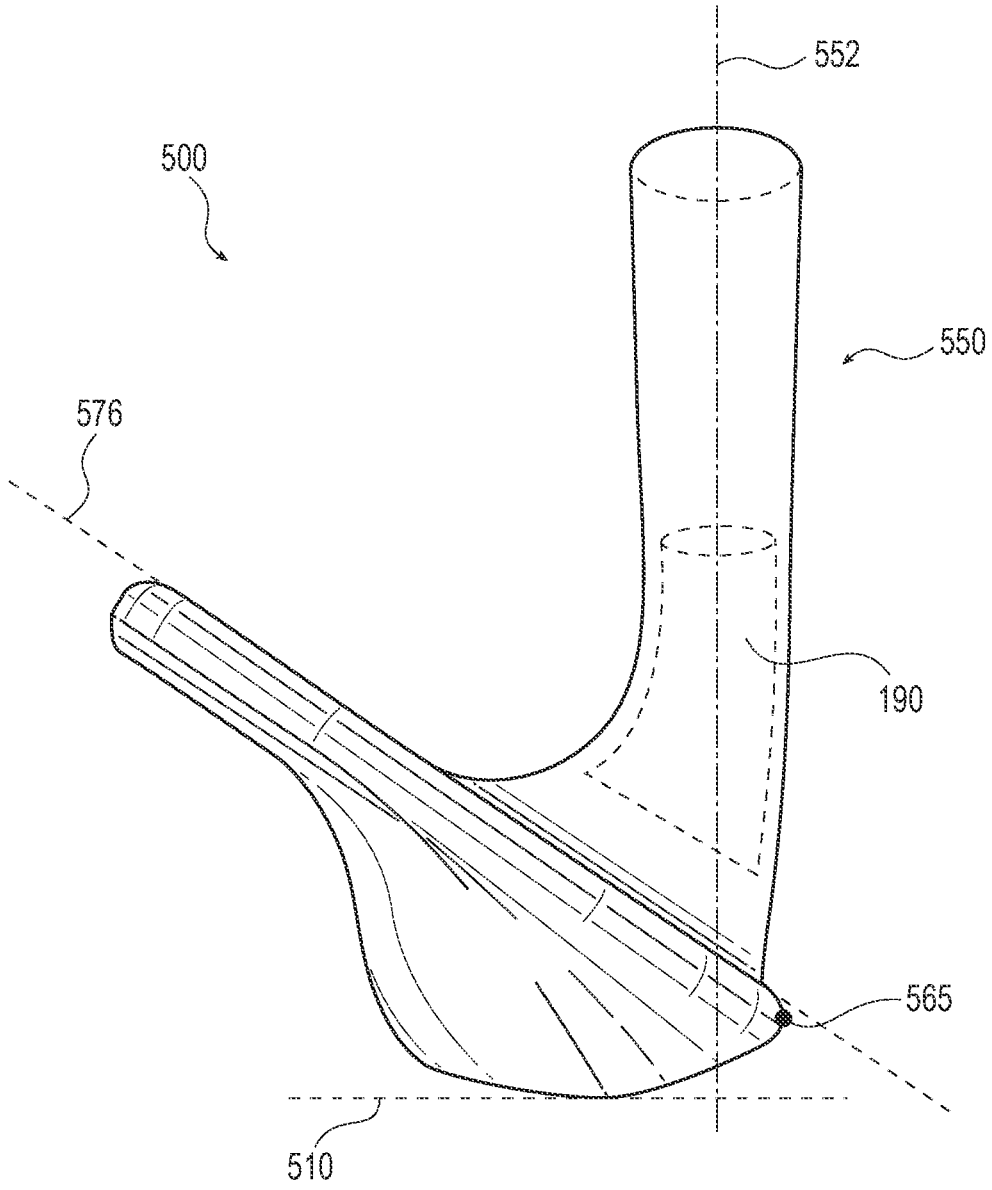
FIG. 25 shows a toe-side elevation view of the golf club head of FIG. 20.
Figure 26:
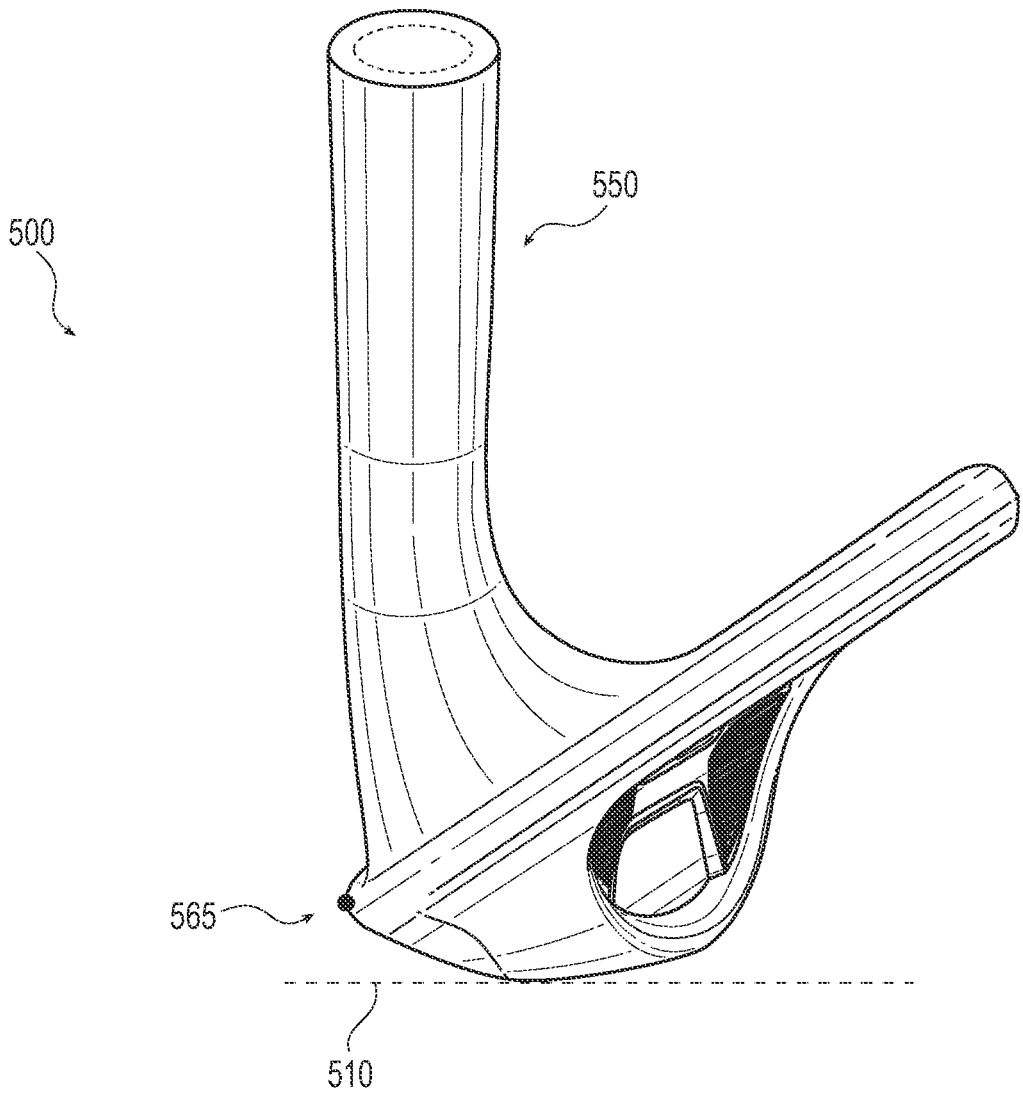
FIG. 26 shows a heel-side elevation view of the golf club head of FIG. 20.
Figure 27:
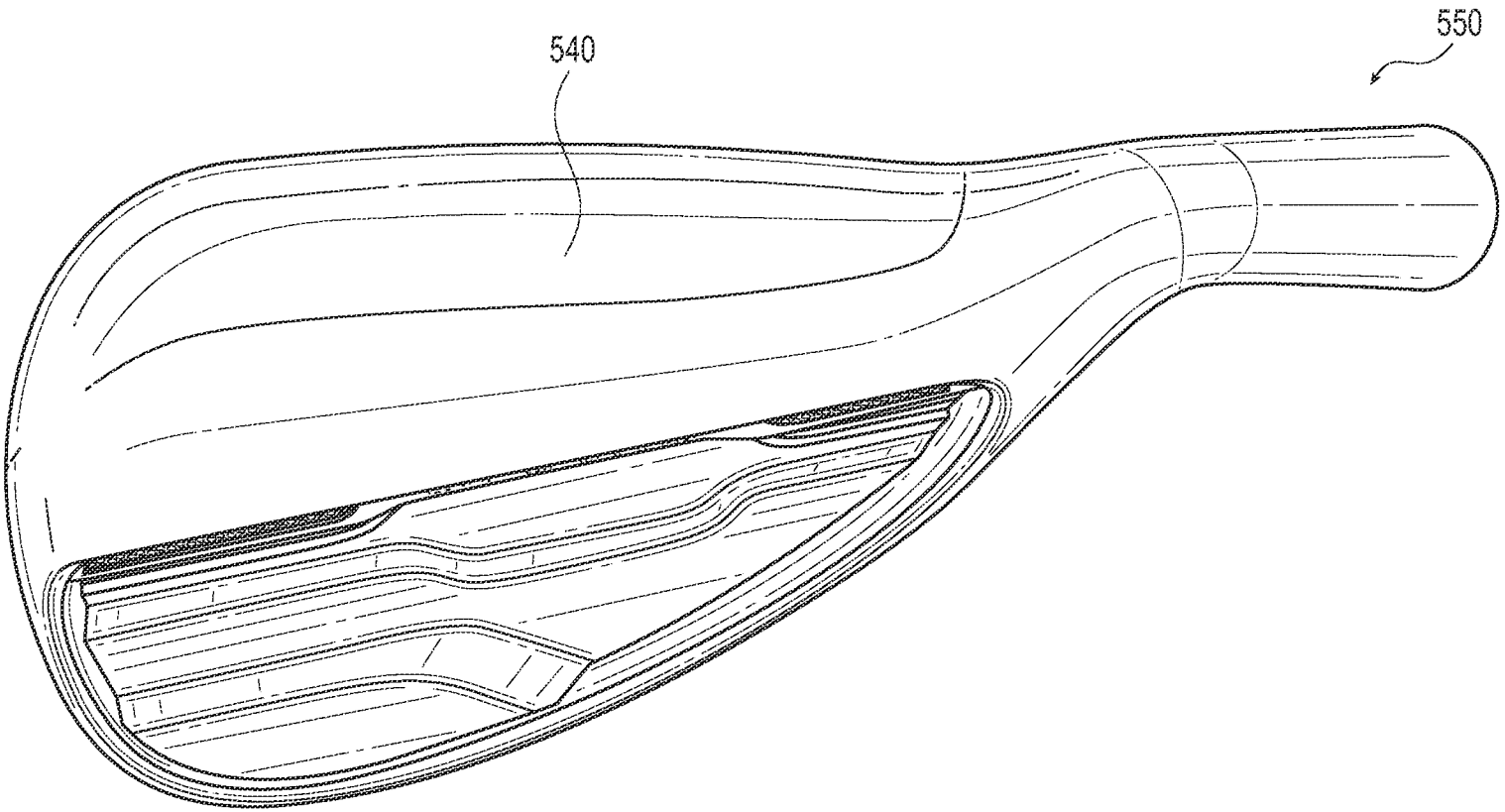
FIG. 27 shows a bottom plan view of the golf club head of FIG. 20.

According to the above, the low-density insert 190 with regard to the embodiment of FIG. 25 preferably has a density no greater than 4 g/cc, more preferably no greater than 3 g/cc and even more preferably equal to about 2 g/cc. Additionally, or alternatively, the low-density insert has a mass no less than 4 g, more preferably, no less than 4.25 g and even more preferably within the range of 4.4 g to 5.25 g. Additionally or alternatively, the low-density insert includes a volume no less than 2 cc, more preferably no less than 2.1 cc and even more preferably within the range of 2.1 cc to 2.75 cc.

However, as described above, applying plural low-density inserts to a set or offering of differently-lofted club heads permits greater design freedom, at least with regard to particular lofts. An offering, as used herein, refers to a plurality of products having similar aesthetic and functional characteristics as to be intended to be and appear as a single product line, whereupon a user is expected to select, from the offering, a set of all or fewer than all of the products of the offering to constitute a set or a portion of a set of golf clubs or golf club heads. A set, or correlated set, as used herein, refers to a plurality of products having similar or correlated functionality and/or aesthetics, either sold or offered to be sold in combination. Therefore, in addition or alternatively to the above, low-density insert volume is preferably related to loft throughout a set or offering in the following manner:

$$\text{Volume} \geq 0.0279\ \text{cc}/^{\circ} * \text{Loft} + 0.7805\ \text{cc}$$

Figure 29:
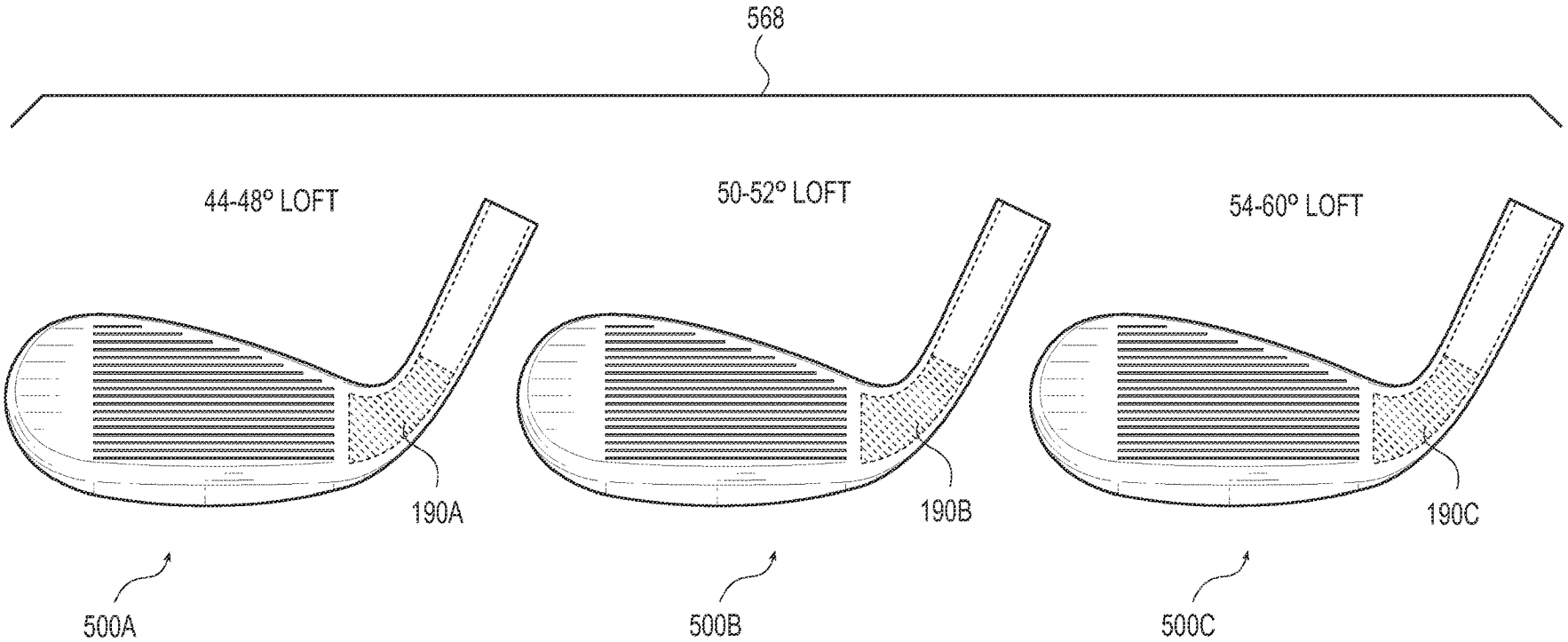
FIG. 29 shows a correlated set of golf club heads in front elevation view in accordance with another embodiment of the present disclosure.

As an example, with reference to FIG. 29, a set or offering of plural golf club heads 568 in accordance with the above disclosure includes golf club heads, e.g. golf club heads 500A, 500B and 500C, that vary in loft. The golf club heads 500A, 500B and 500C may each include a low-density insert 190A, 190B and 190C in accordance with the present disclosure, the low-density insert having properties as follows:

| Loft (Degrees) | Density (g/cc) | Mass (g) | Volume (cc) |
|---|---|---|---|
| 44 to 48 | 2 | 4.42 | 2.21 |
| 50 to 52 | 2 | 4.73 | 2.37 |
| 54 to 60 | 2 | 4.97 | 2.49 |

It is thus contemplated that a set of golf club heads (e.g. set or offering 568), e.g. wedge-type golf club heads, of at least three club heads, having unique lofts, may contain low density inserts (in the manner described with regard to FIG. 20), that differ from one specifically-lofted club head to another differently-lofted club head. In some such cases, an identical first low density inserts may be incorporated into a first sub-set of the set of golf club heads (e.g. a first 2-3 club heads), the first sub-set of golf club heads each preferably differing in loft, while second identical low density inserts (that are differently shaped from the first low density inserts) may be incorporated into a second sub-set of the set of golf club heads (e.g. a second 2-3 club heads), the second sub-set of golf club heads preferably differing in loft. In some such embodiments, a differently-shaped low density insert may correspond to each of the differently-lofted club heads of the set of golf club heads. However, such embodiment may result in increased manufacturing costs that, from a practical standpoint, may not be worth the incremental mass-related benefits achieved. Accordingly, greater discretionary mass is achieved, which discretionary mass may be relocated to more desirable regions of the club head, and removed from regions of the club head where mass removal may be desirable, e.g. proximate the heel portion and/or in close proximity to the y-axis (i.e. the horizontal heel-toe axis passing through the center of gravity of the club head when the club head is oriented in the reference position relative to a virtual ground plane 510). In turn, Iyy may be further increased.

Preferably in combination with enlarging the low-density insert as discussed above, mass is relocated to various extremities of the club head, preferably proximate the hosel portion 550. For example, the hosel 550 may be lengthened as a result of incorporating the low-density insert. Preferably the hosel length is no less than 78 mm, more preferably no less than 80 mm, even more preferably equal to about 85 mm, but preferably not exceeding 90 mm. In this manner, moment of inertia properties are further improved. For example, Iyy is likely to increase as mass is relocated to regions more vertically distant relative to the y-axis. Izz may be increased as mass is relocated to regions more laterally distant from the z-axis about which Izz is measured. Furthermore, given that mass is removed proximate heel-ward locations and relocated proximate the hosel 550, the desirable lateral (heel-to-toe) positioning of the center of gravity may be generally maintained (changes in distance from an axis has a significantly greater effect on MOI than on center of gravity location). Preferably, the center of gravity is spaced from the virtual vertical center plane 566 by a distance D7 (see e.g. FIG. 22) that is no greater than 5 mm. However, provided the greater mass and volume of the low-density insert, even greater enhancements to this dimension may be achieved. Accordingly, D7 is more preferably no greater than 2 mm, and even more preferably no greater than 1.25 mm.

In addition, the center of gravity preferably has a depth from the striking face plane 576, D5, (see FIG. 23) measured normal to the striking face plane 576 where a positive value corresponds with a rearward direction, of no greater than 2.5 mm, more preferably no greater than 2.25, and even more preferably no greater than 2 mm. In some embodiments, the depth of the center of gravity may be a negative value indicating that the center of gravity is forward of the striking face 560. Such embodiments are particularly viable as a large amount of discretionary mass is incorporated into the hosel 550. These values on one hand indicate that the golf club head 500, in qualitatively terms, is blade-like, or solid, in appearance and/or feel. On the other hand, these values may serve as an indication that the club head sweet spot is relatively low on the striking face 560, which may be considered a particularly desirable feature with regard to wedge-type golf club heads, in consideration of the golf club head's ability to generate beneficial spin upon impact.

Additionally or alternatively, the depth of the center of gravity, D5, is preferably related to club head loft. For example, preferably, D5≤7.69 mm−0.074 mm/°*L. More preferably, D5≤7.19 mm−0.074 mm/°*L. These relationships ensure the benefits described above associated with D5 in absolute form, but take into account the natural tendency of D5 to vary in correlation with club head loft.

Based on the above configurations, Iyy is preferably no less than 1000 g*cm$^2$ and more preferably no less than 1100 g*cm$^2$. Additionally, or alternatively, Izz is preferably no less than 3000 g*cm$^2$, more preferably no less than 3250 g*cm$^2$, and even more preferably no less than 3300 g*cm$^2$. These values are believed to increase expected ball carry distance and/or expected ball impact velocity as considered across an array of locations about the striking face 560 using a probability-based model as described above, thereby increasing the overall expected performance of the golf club head 500.

Figure 23:
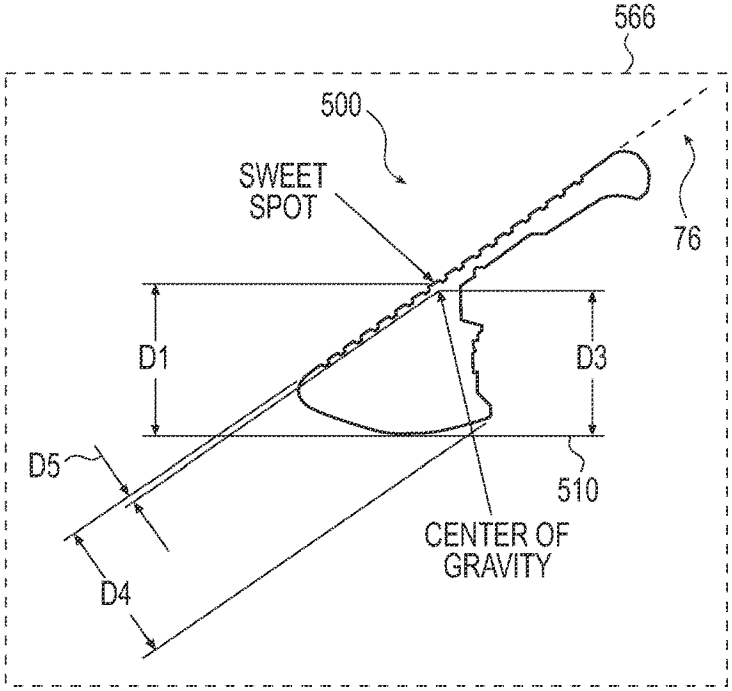
FIG. 23 shows a cross-section view of the golf club head of FIG. 20 through the virtual center plane 566.
Figure 22:
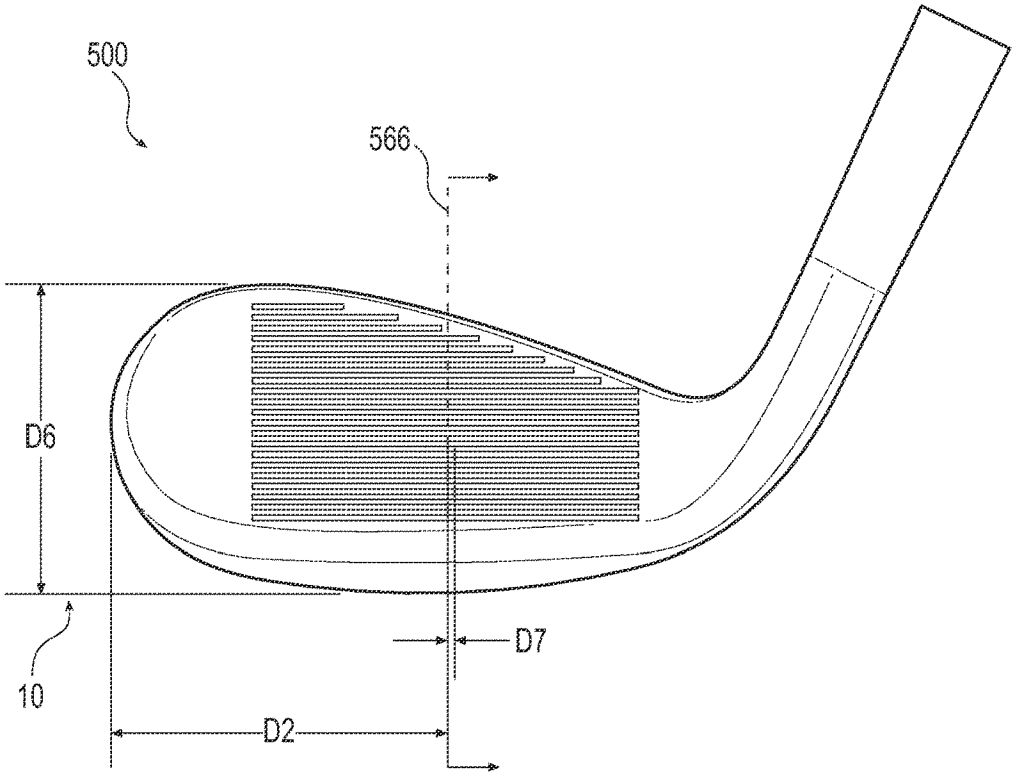
FIG. 22 shows a front elevation view of the golf club head of FIG. 20 with reference dimensions.

With reference to FIG. 23, in addition or alternatively, the sweet spot of the club head 500 has a height, D1, measured vertically from the virtual ground plane 10 of preferably no greater than 24 mm, more preferably between 19 mm and 23 mm. Relatedly, the center of gravity has a height, D3, that is preferably no greater than 22 mm and more preferably in the range of 19 mm to 21.5 mm. Additionally or alternatively, the club head 500 has an overall depth, D4, measured rearward from the striking face plane 576 and in a direction perpendicular to the striking face plane 576, of preferably no greater than 23 mm, more preferably no greater than 22 mm and even more preferably within the range of 17 mm to 22 mm. The club head 500 further has a toe width dimension, D2, being the lateral distance between the face center 564 and the toe-ward-most extend of the club head. D2 is preferably no less than 44 mm, more preferably no less than 45 mm, and even more preferably within the range of 45 mm to 48 mm. Additionally or alternatively, the club head 500 includes a club head height dimension, D6, being the vertical extent of the body of the club head excluding the hosel portion 550. The height D6 is preferably no less than 38 mm and more preferably within the range of 39 mm to 49 mm.

As described above, in view of probability-based modelling, it is contemplated that it may be more desirable to enhance Iyy while maintaining or providing less enhancement to Izz. Accordingly, a ratio of Iyy/Izz is preferably no less than 0.25, more preferably no less than 0.28, even more preferably no less than 0.30 and yet even more preferably no less than 0.32. Preferably, such ratio is within a range of 0.30 to 0.35. Such characteristics further improve the overall probability-based expected performance of the club head 500.

Exemplary values of the aforementioned dimensions D1 through D7 for each of an offering of plural club heads varying in loft are as follows (where dimensions are in millimeters):

| Loft (Degrees) | D1 | D2 | D3 | D4 | D5 | D6 | D7 |
|---|---|---|---|---|---|---|---|
| 44 | 22.85 | 47.06 | 21.45 | 21.53 | 2.02 | 48.5 | 1.15 |
| 46 | 22.81 | 46.92 | 21.53 | 20.92 | 1.78 | 47.92 | 1.04 |
| 50 | 22.43 | 46.8 | 21.35 | 20.35 | 1.41 | 46.65 | 0.93 |
| 52 | 21.95 | 47.06 | 21.05 | 19.96 | 1.14 | 45.16 | 1.19 |
| 54 | 21.47 | 46.69 | 20.41 | 20.24 | 1.32 | 44.06 | 0.67 |
| 56 | 20.81 | 46.85 | 19.86 | 19.48 | 1.14 | 42.35 | 0.83 |
| 58 | 20.6 | 46.53 | 19.81 | 18.61 | 0.93 | 41.14 | 0.66 |
| 60 | 19.94 | 45.81 | 19.33 | 18 | 0.71 | 39.36 | 0.94 |

As described above, one sought after feature particular to wedge-type golf club heads is their ability to generate backspin upon impact. In addition to the features described above, such as sweet spot location and moment of inertia, other golf club head aspects may aid in contributing to backspin generation. Some such attributes are the surface roughness characteristics of the striking face.

Surface roughness of a striking face of an iron-type, e.g. a wedge-type, golf club head is regulated in various manners by organizations that promulgate rules governing the play of professional golf, e.g. the United States Golf Association (USGA). In particular, the USGA has promulgated rules governing equipment, including rules limiting aspects of surface roughness. These rules in part are considered to limit average surface roughness, Ra, to 180 μin. However, average surface roughness is but a single manner of expressing the characteristics of surface. Therefore, complex surface variations are still possible within the confines of this acceptable space.

Accordingly, with particular attention to play in wet conditions, it was found that overall performance, e.g. backspin generation, may be enhanced by appropriate selection of surface finishing processes. Preferably, aside from scorelines formed in the manner described above, the striking face 500 is preferably textured by media blasting. More preferably, the striking face is preferably finished using a natural sand based media, e.g. a staurolite sand such as STARBLAST™, commercially available through CHEMOURS™ Additionally or alternatively, the media preferably has a Mohs hardness no less than 6.5, and preferably within the range of 7.0 to 7.5. Additionally or alternatively, the media has a specific gravity within the range of 3.5 to 4, more preferably within the range of 3.7 to 3.85. Additionally or alternatively, the media has an average diameter within the range of about 100 μm to 200 μm. Preferably, such media blast occurs subsequent to, and upon, an application of a Ni—Cr coating.

As described above, the present golf club head embodiment of FIG. 20, considered individually or as a set or offering of plural loft-varying golf club heads is preferably intended to fall within the class of game improvement club heads. Accordingly, it is preferable to recognize, in broad terms, the position of such offerings. For example, in this particular class of golf clubs, irons appear to be trending "stronger," e.g. have lower lofts associated with their numeric designation as compared with historical reference. As a result, and in optional combination with the aforementioned features, it may be desirable to include within such a set or offering, e.g. set 568, a wedge-type club head having a loft less than 46 degrees, more preferably between about 40 degrees and 46 degrees, and even more preferably equal to about 44 degrees. Such would assist in bridging a potential gap in lofts between a pitching wedge, which—based on this trend—may be lofted anywhere from about 38 degrees to 43 degrees.

In most significant respects, this lower-lofted wedge preferably bears all features described above with regard to the embodiment of FIG. 20. However, some variation may be preferable based on the uniquely low loft of this wedge, for example, as a golfer may tend toward using it more with behavior akin to an iron-type golf club.

Figure 24:
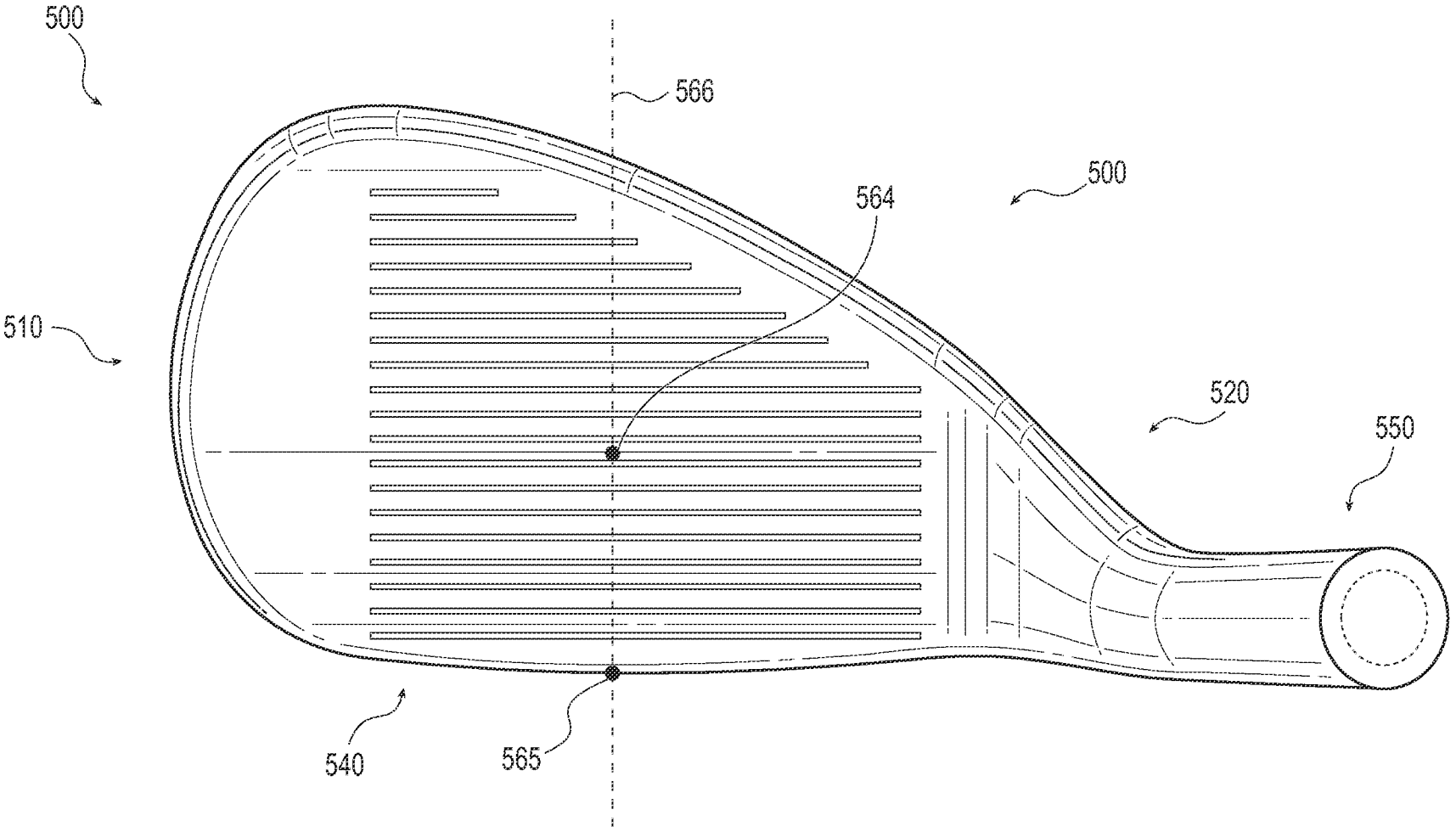
FIG. 24 shows a top plan view of the golf club head of FIG. 20.
Figure 28:
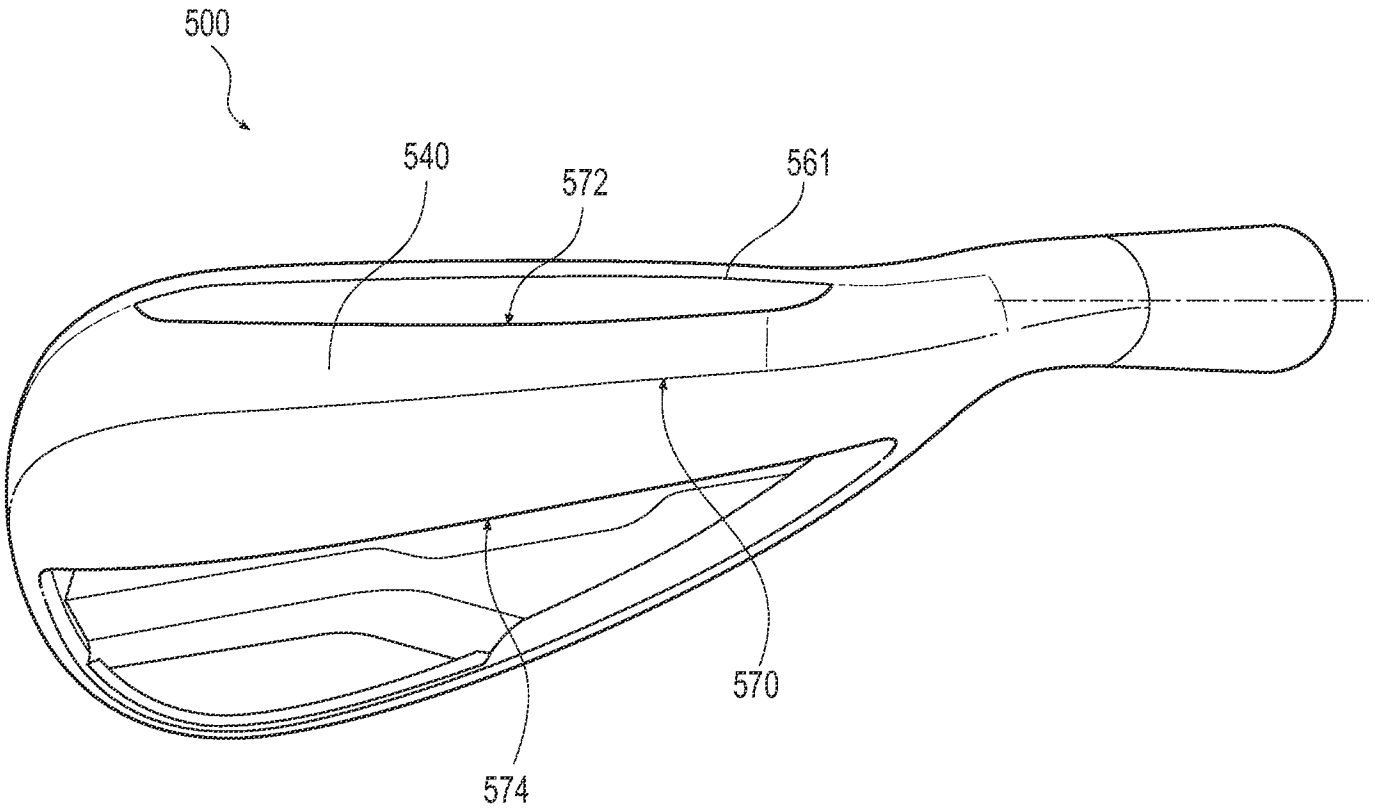
FIG. 28 shows a bottom plan view of a golf club head in accordance with another embodiment of the present disclosure.

For example, the lower-lofted club head 500 (e.g. having a loft between 42-46, preferably 44 degrees) of FIG. 24 includes a sole portion 540 that has a sole grind that differs from club heads of greater loft within the same club head set or offering. As shown in FIG. 28, a first grind edge 570 runs general in the heel to toe direction and generally centrally between the leading edge 561 and trailing edge 574 of the sole portion 540. Compared to one or more club heads of greater loft within the set, this grind results in the sole 540 presenting a "keel" formation that is pulled toward the virtual ground surface. Thus, for example, the club head 500 of FIG. 24 may include a leading edge forwardmost point 565 (see FIG. 20) that has a height relative to the virtual ground plane 510 greater than at least one—preferably two, and more preferably all—club heads of the set, e.g. set 568, having a greater loft.

Additionally, the sole surface 540 of the lower-lofted club head 500 of FIG. 24 includes a second grind edge 572 forward of the first grind edge 570. The second grind edge 572 preferably follows a generally C-shaped path bowing rearwardly.

These sole features are beneficial in that they anticipate that the golfer may intend to forward press and/or perform chipping shots to a degree significantly greater than with club heads of higher lofts within the set or offering, e.g. set 568 As a result of the first and second grind edges, the effective bounce of such club head may be preferably greater than one or more club heads of greater loft within the same set or offering, more preferably greater than all club heads of the set having a greater loft.

In some aspects, the dual grind sole of the lower-lofted club head 500 of FIG. 24 may be formed by manual polishing. However, alternatively, the grind surfaces may be formed in by casting or forging. In yet other embodiments, and to increase consistency from product to product, the grind surface may be machined e.g. using a robotic arm polishing process.

In the foregoing discussion, the present invention has been described with reference to specific exemplary aspects thereof. However, it will be evident that various modifications and changes may be made to these exemplary aspects without departing from the broader spirit and scope of the invention. Accordingly, the foregoing discussion and the accompanying drawings are to be regarded as merely illustrative of the present invention rather than as limiting its scope in any manner.

What is claimed is:

1. A golf club head that, when oriented in a reference position, comprises:

a striking face having a face center and defining a face plane;

a vertical center plane perpendicular to the face plane and passing through the face center;

a sole portion;

a top portion;

a heel portion;

a toe portion opposite the heel portion;

a hosel configured to receive a shaft and defining a hosel axis;

a club head mass between about 250 g and 320 g;

a loft, L, no less than 39°;

a club head center of gravity spaced rearward from the face plane by a distance, D5, and spaced from the vertical center plane by a distance, D7, D7 being no greater than 5 mm, wherein:

$$D5 \leq 7.69\ \text{mm} - 0.074\ \text{mm}/^{\circ} * L;$$

a moment of inertia, Iyy, measured about an axis extending in the heel to toe direction and passing through the center of gravity, Iyy being no less than 1000 g*cm$^2$; and a ratio of Iyy/Izz no less than 0.25, Izz being a moment of inertia measured about a virtual vertical axis passing through the center of gravity.

2. The golf club head of claim 1, wherein Izz is no less than 2800 g*cm$^2$.

3. The golf club head of claim 1, wherein the center of gravity comprises a height, D3, no greater than 22 mm.

4. The golf club head of claim 1, wherein D5 satisfies the following:

$$D5 \leq 5.69\ \text{mm} - 0.074\ \text{mm}/^{\circ} * L.$$

5. The golf club head of claim 1, wherein Iyy is no less than 1100 g*cm$^2$.

6. The golf club head of claim 1, wherein the golf club head comprises a first component comprising a first material having a first melting point and a first density and a second component comprising a second material having a second melting point higher than the first melting point and a second density less than the first density, the second component at least partially encapsulated by the first component.

7. The golf club head of claim 6, wherein the second density is no greater than 2.5 g/cm$^3$.

8. The golf club head of claim 6, wherein the second material comprises a ceramic material.

9. The golf club head of claim 6, wherein a minimum thickness of the first component surrounding the second component is 0.75 mm.

10. A golf club head that, when oriented in a reference position, comprises:

a striking face having a face center and defining a face plane;

a vertical center plane perpendicular to the face plane and passing through the face center;

a sole portion;

a top portion;

a heel portion;

a toe portion opposite the heel portion;

a hosel configured to receive a shaft and defining a hosel axis;

a club head mass between about 250 g and 320 g;

a loft, L, no less than 39°;

a club head center of gravity spaced rearward from the face plane by a distance, D5, D5 being no greater than 2.2 mm, and spaced from the vertical center plane by a distance, D7, D7 being no greater than 5 mm;

a moment of inertia, Iyy, measured about an axis extending in the heel to toe direction and passing through the center of gravity, Iyy being no less than 1000 g*cm$^2$; and a first component comprising a first material having a first melting point and a first density and a second component comprising a second material having a second melting point higher than the first melting point and a second density less than the first density, the second component at least partially encapsulated by the first component, wherein a ratio of Iyy/Izz is no less than 0.25, Izz being a moment of inertia measured about a virtual vertical axis passing through the center of gravity.

11. The golf club head of claim 10, wherein Izz is no less than 2800 g*cm$^2$.

12. The golf club head of claim 10, wherein the center of gravity comprises a height, D3, no greater than 22 mm.

13. The golf club head of claim 10, wherein D5 satisfies the following:

$$D5 \leq 5.69\ \text{mm} - 0.074\ \text{mm}/^{\circ} * L.$$

14. The golf club head of claim 10, wherein Iyy is no less than 1100 g*cm$^2$.

15. The golf club head of claim 10, wherein the second density is no greater than 2.5 g/cm$^3$.

16. The golf club head of claim 10, wherein the second material comprises a ceramic material.

17. The golf club head of claim 1, wherein the ratio of Iyy/Izz is within a range of 0.30 to 0.35.

18. The golf club head of claim 10, wherein the ratio of Iyy/Izz is within a range of 0.30 to 0.35.

* * * * *